US006474764B2

(12) United States Patent
Kao et al.

(10) Patent No.: US 6,474,764 B2
(45) Date of Patent: Nov. 5, 2002

(54) CONTROL CIRCUIT FOR DRIVING A PRINT HEAD OF A PRINTING APPARATUS

(75) Inventors: Chih-Hung Kao, Taipei (TW); Yu-Fan Fang, Taipei (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 09/683,024

(22) Filed: Nov. 9, 2001

(65) Prior Publication Data

US 2002/0057305 A1 May 16, 2002

(30) Foreign Application Priority Data

Nov. 20, 2000 (TW) ..... 089123781

(51) Int. Cl.[7] ..... B41J 29/38; B41J 29/393
(52) U.S. Cl. ..... 347/14; 347/19
(58) Field of Search ..... 347/14, 60, 57, 347/19, 11, 12, 40, 42, 56

(56) References Cited

U.S. PATENT DOCUMENTS 5,526,027 A * 6/1996 Wade et al. ..... 347/14
6,224,195 B1 * 5/2001 Maru et al. ..... 347/56
6,254,214 B1 * 7/2001 Murthy et al. ..... 347/17
6,270,180 B1 * 8/2001 Arakawa et al. ..... 347/14

* cited by examiner

*Primary Examiner*—John Barlow
*Assistant Examiner*—Charles W. Stewart, Jr.
(74) *Attorney, Agent, or Firm*—Winston Hsu

(57) ABSTRACT

A control circuit for driving a print head of a printing apparatus is disclosed. The print head has a plurality of heating elements and a plurality of ink chambers. Each ink chamber stores ink and has a nozzle. The control circuit includes a thermometer for measuring a temperature of the ink chambers, and a processor for generating a heating signal according to printing data transmitted from the printing apparatus to drive heating elements to heat ink chambers corresponding to nozzles which will jet ink. The processor also generates a pre-heating signal to drive the heating elements according to the temperature measured by the thermometer. When necessary, the processor will generate the pre-heating signal in addition to generating the heating signal so as to provide additional energy to drive the heating elements corresponding to the nozzles which will jet ink.

23 Claims, 21 Drawing Sheets

170

| | | | | | | |
|---|---|---|---|---|---|---|
| Heat-accumulation index (m) | 1 | 2 | 3 | 4 | 5 | . . . |
| Heat-accumulation weighting (W(m)) | a | b | c | d | e | . . . |
| Heat-accumulation weighting (W(m)) value | 1 | 2 | 3 | 4 | 5 | . . . |

172 174 176

Fig. 6A

180

| | | | | | | |
|---|---|---|---|---|---|---|
| Heat-dilution index (k) | 1 | 2 | 3 | 4 | 5 | . . . |
| Heat-dilution weighting (C(k)) | A | B | C | D | E | . . . |
| Heat-dilution weighting (C(k)) value | 0 | 1 | 1 | 2 | 2 | . . . |

182 184 186

Fig. 6B

CONTROL CIRCUIT FOR DRIVING A PRINT HEAD OF A PRINTING APPARATUS

BACKGROUND OF INVENTION

1. Field of the Invention

The present invention relates to a control circuit for driving a print head of a printing apparatus, and more particularly, to a control circuit for driving a print head of a printing apparatus to make temperature compensation and provide uniform ink spots.

2. Description of the Prior Art

Please refer to FIG. 1. FIG. 1 is a schematic diagram of a prior art print head 70. The print head 70 comprises an ink reservoir 72, a plurality of tubes 74 and a plurality of ink chambers 76. The plurality of tubes 74 connects the ink reservoir 72 to the plurality of ink chambers 76. Ink inside the ink reservoir 72 can flow through the tubes 74 to the ink chambers 76. Inside each ink chamber 76 is a heating resistor 78 that heats up the ink, increasing the ink's thermal energy. When the thermal energy of the ink in the ink chamber 76 is above a predetermined threshold, the ink generates bubbles 80 to eject ink spots from a nozzle 82 for printing. When the nozzle 82 receives many instructions successively to eject ink spots, the heating resistor 78 of the nozzle 82 continually heats up, and ink inside the ink chamber 76 has a higher temperature and a lower viscosity. If, however, another nozzle 82 receives fewer instructions to eject ink spots, ink inside the ink chamber 76 has a lower temperature and a higher viscosity. If the same amount of energy is used to drive the heating resistors 78 of these two nozzles 82, non-uniform ink spots are ejected and the printing quality is lowered. So, it is preferable that the energy provided by the heating resistor 78 in the print head 70 not only makes the thermal energy of ink in the ink chamber 76 higher than the predetermined threshold, but can also be adjusted to make the sizes of ejected ink spots uniform so as to optimize printing quality.

Please refer to FIG. 2. FIG. 2 is a schematic diagram of a prior art driving circuit of a print head. For example, a driving circuit 10 can receive an input of eight printing data 30 and produce eight controlling signals (D1, D2, D3, D4, D5, D6, D7, D8) to output to a print head 40. The print head 40 has a heating circuit 42 and eight ink chambers (R1, R2, R3, R4, R5, R6, R7, R8). The driving circuit 10 has a shift register 22, a latching circuit 24 and a driving module 26. The shift register 22 receives binary printing data 30 transmitted serially from the printing apparatus. Then, the latching circuit 24 latches the printing data 30 and stores the printing data 30 in the latching circuit 24 according to a latching signal 34. The driving module 26 consists of a plurality of AND gates 28 and causes the heating circuit 42 in the print head 40 to heat up each predetermined ink chamber according to a driving signal 36. The heating circuit 42 consists of a plurality of heating resistors 78 and transistor switches 44. Each transistor switch 44 is linked from its corresponding control signal (D1, D2, D3, D4, D5, D6, D7, D8) to the AND gate it controls. When a specific control signal is turned on, the corresponding transistor switch 44 turns on, current flows through the corresponding heating resistor 78, the corresponding ink chamber is heated up, and ink inside the ink chamber is ejected as ink spots to print.

Please refer to FIG. 3. FIG. 3 is a timing diagram for a first driving pattern of a prior art print head. The thermal energy of ink inside the ink chamber 76 is influenced by energy provided by the heating resistor 78 and other factors, such as the number of ink chambers to be driven in a printing process. When there are more ink chambers to be driven in a printing process, the heating resistor 78 provides less energy to these ink chambers. Between T0 and T1, eight printing data 30 are input sequentially to the shift register 22 via the control of a pulse signal 32. When the latching signal 34 produces a pulse, binary bits of eight printing data 30 are respectively latched in the latching circuit 24. Between T1 and T2, a pulse 37 is produced in the driving signal 36. The AND gate 28 of the driving module 26 then decides whether or not to output the pulse of the corresponding driving signal 36, depending on whether the latched printing data 30 in latching circuit 24 is a "1" or a "0." For example, between T0 and T1, the printing data 30 are (1, 1, 1, 1, 0, 0, 0, 0). When the pulse 37 of the driving signal 36 is produced between T1 and T2, the corresponding transistor switch is on and a current flows through the corresponding heating resistors to heat up the corresponding ink chambers (R1, R2, R3, R4) to eject ink spots. Other transistors that are off do not conduct, so the corresponding heating resistors have no current and the corresponding ink chambers (R5, R6, R7, R8) are not heated. As a result, no ink spots are ejected from those chambers.

Between T1 and T2, printing data is renewed to (1, 1, 1, 1, 1, 0, 0, 0). So, between T2 and T3, a pulse 38 of the driving signal 36 is produced and corresponding ink chambers (R1, R2, R3, R4, R5) are heated to eject ink spots. Other ink chambers (R6, R7, R8) are not heated, so they do not eject ink spots. The duration of pulses 37, 38, and 39 is the same, but their voltages are different. The voltage of pulse 38 is lower than that of pulse 37 because five ink chambers are driven with less energy provided by heating resistor 78 in the second printing process compared to four ink chambers driven with more energy in the first printing process. For the same reason, six ink chambers are driven with even less energy in the third printing process, so the voltage of pulse 39 is lower than the voltages of both pulses 37 and 38.

Please refer to FIG. 4. FIG. 4 is a timing diagram of a second driving pattern of a prior art print head. FIG. 3 showed a case where the printing data 30 is concentrated (1, 1, 1, 1, 0, 0, 0, 0). FIG. 4 is different in that the printing data 30 is more dispersed (0, 1, 1, 0, 0, 1, 1, 0), (1, 0, 0, 1, 0, 1, 0, 1). Because the prior art only considers the number of ink chambers to be driven to eject ink drops, the duration and voltages of pulses 47, 48, 49 of the driving signal 36, and the energy provided to heating resistor 78, are the same. In fact, the thermal energy of ink inside the ink chamber 76 is influenced by other factors, one being active ink chambers in proximity to reserved ink chambers. As shown in FIG. 4, the distribution of the active ink chambers in the first printing process is concentrated, so the thermal energy of ink inside these ink chambers is actually higher. However, the distribution of the active ink chambers in the third printing process is very dispersed, so the thermal energy of the ink inside these ink chambers is actually lower. This situation is not considered in the prior art as shown in FIG. 4. Ejected ink spots are still not uniform in size and the printing quality is influenced.

SUMMARY OF INVENTION

It is therefore a primary objective of the claimed invention to provide a control circuit for driving a print head of a printing apparatus to make temperature compensation and provide uniform ink spots.

According to the claimed invention, a control circuit for driving a print head of a printing apparatus is provided. The print head comprises a plurality of heating elements and a plurality of corresponding ink chambers. Each ink chamber is used for storing ink and has a nozzle. The control circuit includes a thermometer for measuring a temperature of the ink chambers, and a processor for generating a heating signal according to printing data transmitted from the printing apparatus to drive heating elements to heat ink chambers corresponding to nozzles which will jet ink drops, so as to cause the nozzles to jet ink drops. The processor also includes a pre-heating signal to drive the heating elements according to the temperature measured by the thermometer. If the processor is to generate the pre-heating signal, the processor will generate the pre-heating signal in addition to generating the heating signal so as to provide additional energy to drive the heating elements corresponding to the nozzles that will jet ink.

It is an advantage of the claimed invention that the control circuit makes temperature compensation according to a temperature of the print head and heat-accumulation weightings to make ejected ink spots uniform in size so as to improve printing quality of a printer.

These and other objects and the advantages of the present invention will no doubt become obvious to those of ordinary skill in the art after having read the following detailed description of the preferred embodiment that is illustrated in the various figures and drawings.

BRIEF DESCRIPTION OF DRAWINGS

FIGS. 6A and 6B are schematic diagrams of a heat-accumulation weighting table and a heat-dilution weighting table according to the present invention.

DETAILED DESCRIPTION

The present invention focuses on an improvement of a control circuit and a driving method of a print head in a printing apparatus. Since the structure of the print head is the same as the one shown in FIG. 1, the structure of the print head is hereby not described in detail.

To make the description in the present application clearer, some terms are defined as follows. A reserved nozzle is a nozzle desired not to jet ink drops in a printing process, and a reserved ink chamber is an ink chamber whose corresponding nozzle is desired not to jet ink drops in a printing process. An active nozzle is a nozzle desired to jet ink drops in a printing process, and an active ink chamber is an ink chamber whose corresponding nozzle is desired to jet ink drops in a printing process.

Figure 5:
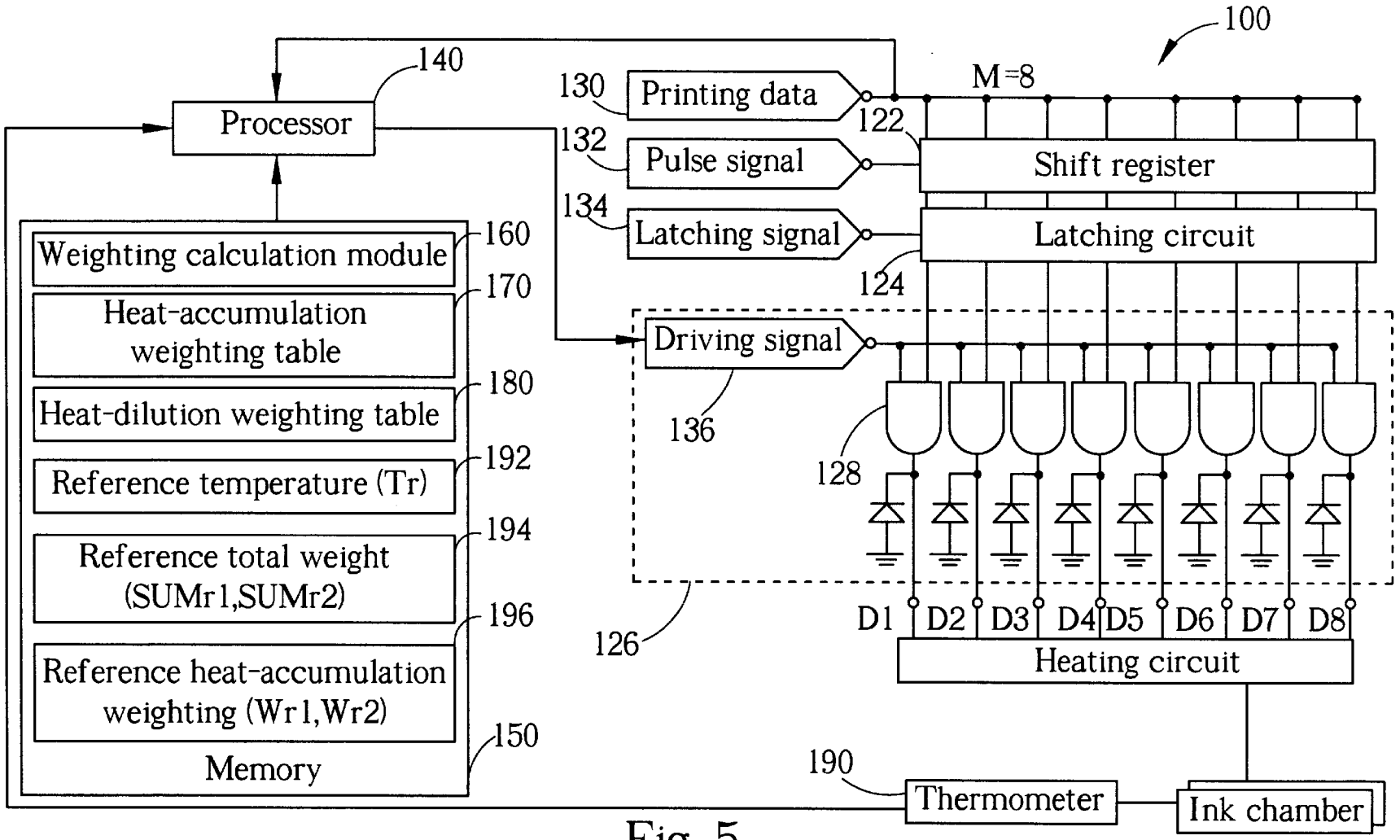
FIG. 5 is a schematic diagram of a control circuit in a print head according to the present invention.

Please refer to FIG. 5. FIG. 5 is a schematic diagram of a control circuit 100 in a print head according to one embodiment of the present invention. The control circuit 100 includes a shift register 122, a latching circuit 124, a processor 140, a memory 150, a driving module 126, and a thermometer 190. The shift register 122 receives printing data 130 transmitted from a printing apparatus. The printing data 130 is binary digital data, which is either 0 or 1. The latching circuit 124 latches and stores the printing data 130 in the latching circuit 124 according to a latching signal 134. The processor 140 controls all operations of the control circuit 100, including processing data and executing programs. The memory 150 stores a heat-accumulation weighting table 170, a heat-dilution weighting table 180 and a weighting calculation module 160. The heat-accumulation weighting table 170 defines a heat-accumulation weighting of each active nozzle according to the distribution of adjacent active nozzles. The heat-dilution weighting table 180 defines a heat-dilution weighting of each reserved nozzle according to the distribution of adjacent reserved nozzles. The weighting calculation module 160 calculates the total weight according to the heat-accumulation weightings of all active nozzles and the heat-dilution weightings of all reserved nozzles.The processor 140 determines whether or not to generate a pre-heating signal in addition to a heating signal in a driving signal according to both a temperature measured by the thermometer 190 and the total weight. Then, the driving signal is outputted to the driving module 126. The pre-heating signal is merely used to heat up the ink, and the heating signal is then used to generate bubbles so as to jet the ink. The driving module 126 comprises a plurality of AND gates 128. The AND gates 128 provide driving signals to the corresponding heating resistors of the active nozzles so as to jet the ink from the active nozzles.

Please refer to FIGS. 6A and 6B. FIGS. 6A and 6B are schematic diagrams of a heat-accumulation weighting table 170 and a heat-dilution weighting table 180 according to this embodiment. The heat-accumulation weighting table 170 contains three rows: a heat-accumulation index (m) 172, a heat-accumulation weighting (W(m)) 174 and a heat-accumulation weighting value 176. The weighting calculation module 160 in the control circuit 100 calculates the heat-accumulation weightings of all active nozzles. Then the processor 140 determines whether or not to generate the pre-heating signal transmitted to the driving module 126 according to the total weight and the temperatures of the print head and the ink chamber measured by the thermometer 190. Since the energy accumulation condition is closely related to the number of consecutive active nozzles, each consecutive active nozzle is defined a heat-accumulation index m 172, and is assigned a corresponding heat-accumulation weighting W(m) 174. The first active nozzle is defined a heat-accumulation index 1, and is assigned a heat-accumulation weighting W(1)=a; the second consecutive active nozzle is defined a heat-accumulation index 2, and is assigned a heat-accumulation weighting W(2)=b; the third consecutive active nozzle is defined a heat-accumulation index 3, and is assigned a heat-accumulation weighting W(3)=c; the fourth consecutive active nozzle is defined a heat-accumulation index 4, and is assigned a heat-accumulation weighting W(4)=d, . . . , etc. The value of the heat-accumulation weighting W(m) 174 for each consecutive active nozzle is determined by estimation and experimental measurements. In this embodiment, W(1)=a=1, W(2)=b=2, W(3)=c=3, W(4)=d=4, W(S)=e=5, . . . , etc. In a simplified example, if there are 10 nozzles arranged in a line and three adjacent nozzles of which are desired to jet ink drops, it is regarded that there are three consecutive active nozzles. These active nozzles will be defined as heat-accumulation index 1, 2, and 3 respectively. The heat-accumulation weightings 174 of the first active nozzle, the second consecutive active nozzle, and the third consecutive active nozzle are respectively represented as a, b, c. According to the heat-accumulation weighting table 170, the heat-accumulation total weight will be Wtotal=W(1)+W(2)+W(3)=a+b+c=6. The heat-accumulation total weight Wtotal=6 indicates the heat accumulation condition of the print data in this printing process.

Similarly, the heat-dilution weighting table 180 has three rows: a heat-dilution index (k) 182, a heat-dilution weighting (C(k)) 184 and a heat-dilution weighting value 186. The weighting calculation module 160 in the control circuit 100 calculates the heat-dilution weightings of all reserved nozzles to obtain a value indicating the energy dilution condition of the reserved nozzles in this printing process. The energy dilution condition is also closely related to the number of consecutive reserved nozzles, so each consecutive reserved nozzle is defined by a heat-dilution index k, and is assigned a heat-dilution weighting C(k). The first reserved nozzle is defined by a heat-dilution index 1, and is assigned a heat-dilution weighting C(1)=A; the second consecutive reserved nozzle is defined by a heat-dilution index 2, and is assigned a heat-dilution weighting C(2)=B; the third consecutive reserved nozzle is defined by a heat-dilution index 3, and is assigned a heat-dilution weighting C(3)=C; the fourth consecutive reserved nozzle is defined by a heat-dilution index 4, and is assigned a heat-dilution weighting C(4)=D, . . . , etc. The value of the heat-dilution weighing W(m) for each consecutive reserved nozzle is determined by estimation and experimental measurements. In this embodiment, C(1)=A=0, C(2)=B=1, C(3)=C=1, C(4)=D=2, C (5)=E =2, . . . , etc. In a simplified example, if there are 10 nozzles arranged in a line and three adjacent nozzles of which are desired not to jet ink drops, it is regarded that there are three consecutive reserved nozzles. These reserved nozzles will be defined as heat-dilution index 1, 2, and 3 respectively. The heat-dilution weightings 184 of the first reserved nozzle, the second consecutive reserved nozzle, and the third consecutive reserved nozzle are respectively A, B, C. According to the heat-dilution weighting table 180, the heat-dilution total weight will be Ctotal=C(1)+C (2)+C(3)=A+B+C=2. The heat-dilution total weight Ctotal=2 indicates a heat dilution condition of the print data in this printing process.

Figure 7:
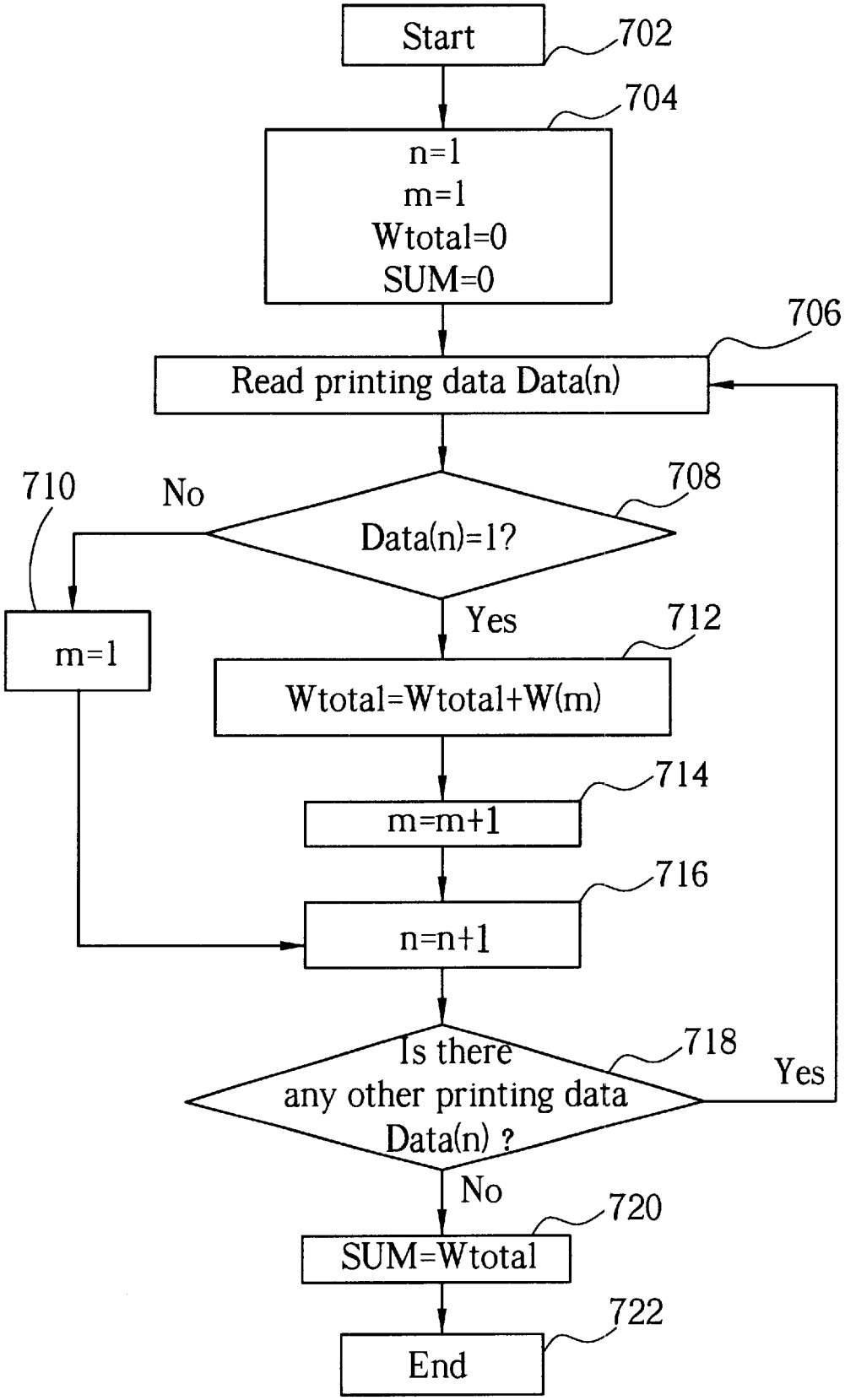
FIG. 7 is a flow chart of an embodiment of a total weighting calculation according to the present invention.

Please refer to FIG. 7. FIG. 7 is a flow chart illustrating the calculation of the total weight according to this embodiment. This flow chart is suitable for estimating the heat-accumulation effect for a print head with the linear nozzle arrangement. It should be noted that more sophisticated algorithms may also be adopted considering various conditions and applications.

step 702: start;

step 704: printing data index n is set to 1; heat-accumulation index m is set to 1; heat-accumulation total weight Wtotal is set to 0; total weight SUM is set to 0;

step 706: read printing data Data(n);

step 708: if printing data Data(n) is 1, go to step 712, if not, go to step 710;

step 710: heat-accumulation index m is set to 1, go to step 716;

step 712: add the heat accumulation weighting W(m) to the heat-accumulation total weight Wtotal;

step 714: add 1 to the heat-accumulation index m;

step 716: add 1 to the printing data index n;

step 718: if there is still other printing data Data(n) in the sequence, go to step 706, if not, go to step 720;

step 720: set total weight SUM as heat-accumulation total weight Wtotal;

step 722: end.

For easier understanding of this embodiment, a simplified example is given below. Assume a print head has eight nozzles arranged in a line, signals received by each nozzle are expressed by: Data(1), Data(2), Data(3), Data(4), Data(5), Data(6), Data(7), and Data(8).

If the signal received by a nozzle is 1, the nozzle is an active nozzle. if the signal received by a nozzle is 0, the nozzle is a reserved nozzle.

EXAMPLE 1

Data(1)=1;
Data(2)=1;
Data(3)=1;
Data(4)=1;
Data(5)=0;
Data(6)=0;
Data(7)=0;
Data(8)=0;

according to the heat-accumulation weighting table 170 in FIG. 6A and the flow chart in FIG. 7:

$$SUM=a+b+c+d=1+2+3+4=10$$

EXAMPLE 2

Data(1)=0;
Data(2)=1;

Data(3)=1;

Data(4)=0;

Data(5)=0;

Data(6)=1;

Data(7)=1;

Data(8)=0;

according to the heat-accumulation weighting table 170 in FIG. 6A and the flow chart in FIG. 7:

$$SUM=a+b+a+b=1+2+1+2=6$$

EXAMPLE 3

Data(1)=1;

Data(2)=0;

Data(3)=0;

Data(4)=1;

Data(5)=0;

Data(6)=1;

Data(7)=0;

Data(8)=1;

according to the heat-accumulation weighting table 170 in FIG. 6A and the flow chart in FIG. 7:

$$SUM=a+a+a+a=1+1+1+1=4$$

In these examples, there are four active nozzles in each printing process, but the distribution of the active nozzles in each printing process is different. The distribution of the active nozzles of the first printing data 30 is concentrated (1, 1, 1, 1, 0, 0, 0, 0). The distribution of the active nozzles of the second printing data 30 is dispersed (0, 1, 1, 0, 0, 1, 1, 0). The distribution of the active nozzles of the third printing data 30 is even more dispersed (1, 0, 0, 1, 0, 1, 0, 1). The weighting calculation module 160 of this embodiment calculates the total weight SUM to have three different values 10, 6, and 4. Therefore, the processor 140 may generate three different pre-heating signals.

Figure 8:
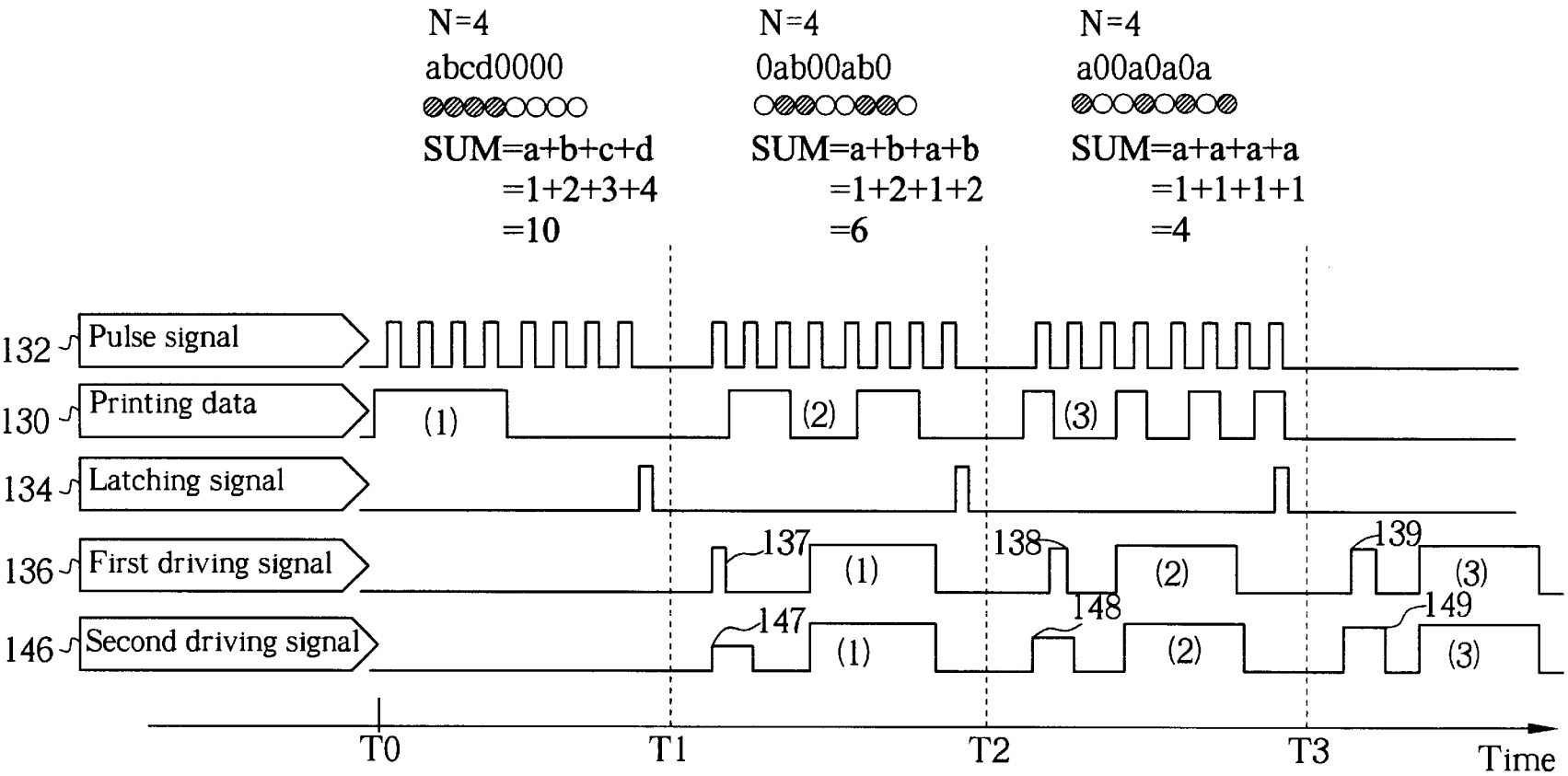
FIG. 8 is a timing diagram of an embodiment of a total weighting calculation according to the present invention.

FIG. 8 is a timing diagram of an embodiment of a total weighting calculation according to the present invention. When there are four nozzles to be driven in a printing process, the larger the total weight SUM is, the more obvious the heat accumulation effect is. Therefore, energy of the corresponding pre-heating signal is smaller (see pre-heating signals 137 and 147). In contrast, if the total weight SUM is smaller, the heat accumulation effect will be less obvious, and the energy of the corresponding pre-heating signal should be larger (see pre-heating signals 139 and 149).

FIG. 8 illustrates two different kinds of driving signals, a first driving signal 136 and a second driving signal 146. Both the first driving signal 136 and the second driving signal 146 are suitable in this embodiment. The only difference is the pre-heating signal through which they generate energy to the nozzles. Pre-heating signals 137, 138 and 139 of the first driving signal 136 have the same voltage value but with different time durations so as to generate different energy levels. Pre-heating signals 147, 148 and 149 of the second driving signal 146 have the same time duration but with different voltage values so as to generate different energy levels. There may be various forms of driving signals so long as they are capable of generating different energy levels to the active nozzles.

In addition, the total weight SUM may simply be divided into two sections for determining proper pre-heating signals. For example, when SUM is smaller than or equal to 12 (SUM<=12), a pre-heating signal is sent; when SUM is larger than 12, a pre-heating signal is not sent. Alternatively, the total weight SUM may also be divided into several sections for determining proper pre-heating signals. For example, when SUM is smaller than or equal to 5 (SUM<=5), a first pre-heating signal is used; when SUM is larger than 5, and smaller than or equal to 9 (5<SUM<=9), a second pre-heating signal is used; when SUM is larger than 9, and smaller than or equal to 12 (9<SUM<=12), a third pre-heating signal is used; when SUM is larger than 12 (SUM>12), a pre-heating signal is not used. The first, second or third driving signal may have different time durations or voltage values to provide different energy levels to the active nozzles.

The control circuit 100 utilizes the thermometer 190 to measure the temperature (T) of the ink chamber in the print head, and compares the measured temperature (T) with a reference temperature (Tr) stored in the memory 150. Thereafter, the control circuit 100 calculates a total weight according to the distribution of active nozzles.

Figure 9:
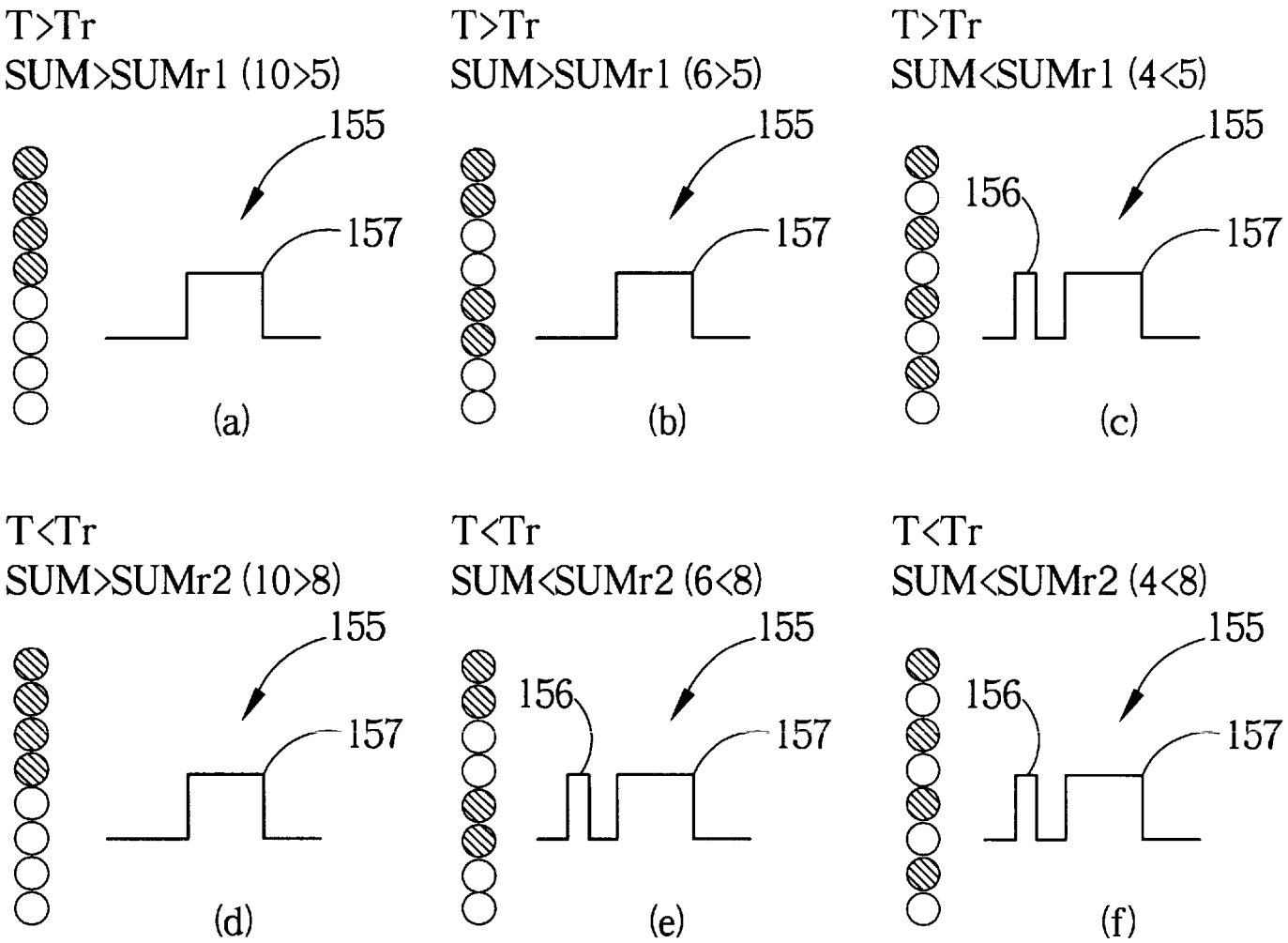
FIG. 9 is a schematic diagram of driving signals under conditions of various ink chamber temperatures and various total weights.

Please refer to FIG. 9. FIG. 9 is a schematic diagram of driving signals 155 under conditions of various ink chamber temperatures (T) and various total weights (SUM). The total weight (SUM) is compared with a first reference total weight SUMr1 or a second reference total weight SUMr2 set previously in the memory 150 to determine the heat accumulation condition of active nozzles. In this embodiment, SUMr1=5 and SUMr2=8. As shown in FIG. 9, when the measured temperature is higher than a reference temperature (T>Tr) and the total weight is larger than the first reference total weight (SUM>SUMr1), the heat accumulation effect will be obvious. Therefore, the applied driving signal 155 comprises a heating signal 157 only, as shown in (a) and (b). When the measured temperature is higher than the reference temperature (T>Tr) and the total weight is smaller than the first reference total weight (SUM<SUMr1), the heat accumulation effect will be regular. Therefore, the applied driving signal 155 comprises a pre-heating signal 156 and a heating signal 157, as shown in (c). When the measured temperature is lower than the reference temperature (T<Tr) but the total weight is larger than the second reference total weight (SUM>SUMr2), the heat accumulation effect is elevated. Therefore, the applied driving signal 155 comprises a heating signal 157 only, as shown in (d). When the measured temperature is lower than the reference temperature (T<Tr) and the total weight is smaller than the second reference total weight (SUM<SUMr2), the heat accumulation effect will be less obvious. Therefore, the applied driving signal 155 comprises a pre-heating signal 156 and a heating signal 157, as shown in (e) and (f).

Figure 10:
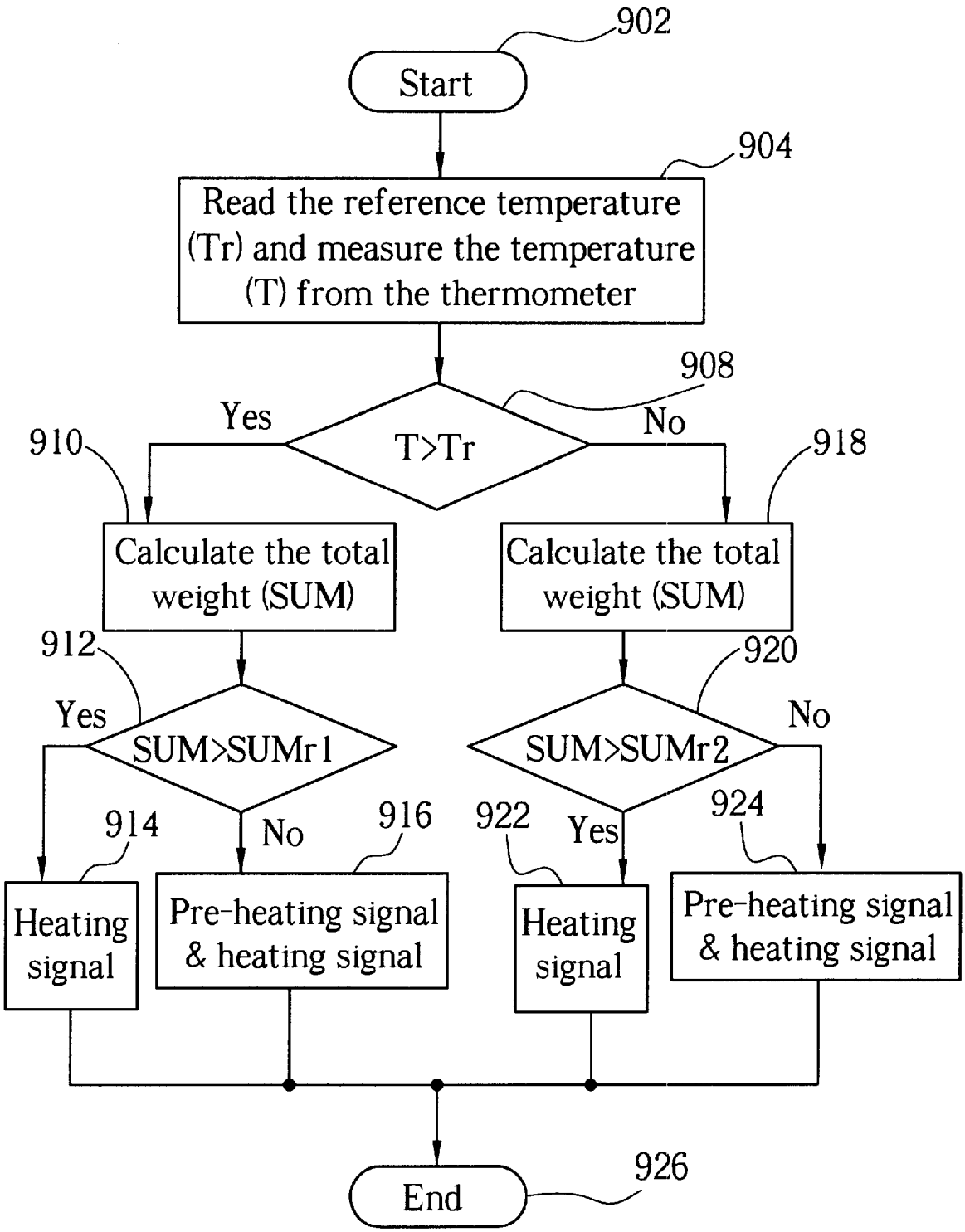
FIG. 10 is a flow chart of a first control procedure according to the present invention shown in FIG. 7.

Please refer to FIG. 10. FIG. 10 is a flow chart of a first control procedure according to the present invention shown in FIG. 7. This flow chart is illustrated below:

step 902: start;

step 904: read a default reference temperature (Tr) in the memory 150, and measure a temperature (T) of the ink chamber in the print head by a thermometer 190;

step 908: if the measured temperature is higher than the reference temperature (T>Tr), go to step 910, if not, go to step 918;

step 910: calculate a total weight (SUM) of the print head according to the flow chart shown in FIG. 7;

step 912: if the total weight is larger than the first reference total weight (SUM>SUMr1), go to step 914, if not, go to 916;

step 914: apply a driving signal containing a heating signal only, go to step 926;

step 916: apply a driving signal containing a pre-heating signal and a heating signal, go to step 926;

step 918: calculate a total weight (SUM) of the print head according to the flow chart shown in FIG. 7;

step 920: if the total weight is larger than the second reference total weight (SUM>SUMr2), go to step 922, if not, go to 924;

step 922: apply a driving signal containing a heating signal only, go to step 926;

step 924: apply a driving signal containing a pre-heating signal and a heating signal, go to step 926;

step 926: end.

The total weight SUM is simply divided into two sections in FIG. 10 for determining whether or not to apply a pre-heating signal. The total weight SUM may also be divided into several sections for transmitting proper pre-heating signals with different pulse durations or different levels of voltage to the driving module 126 so as to provide an appropriate amount of energy to the heating element of the ink chamber.

Figure 11:
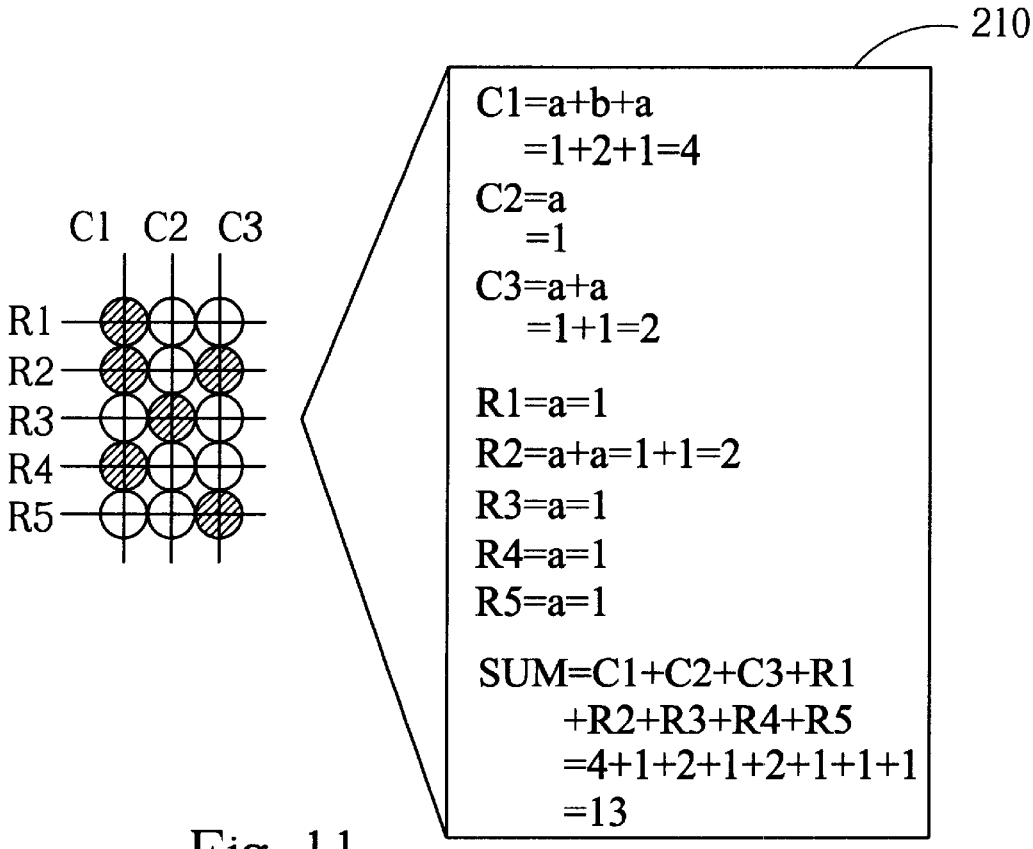
FIG. 11 is a schematic diagram of the total weighting calculation according to the present invention used in a first matrix print head.
Figure 12:
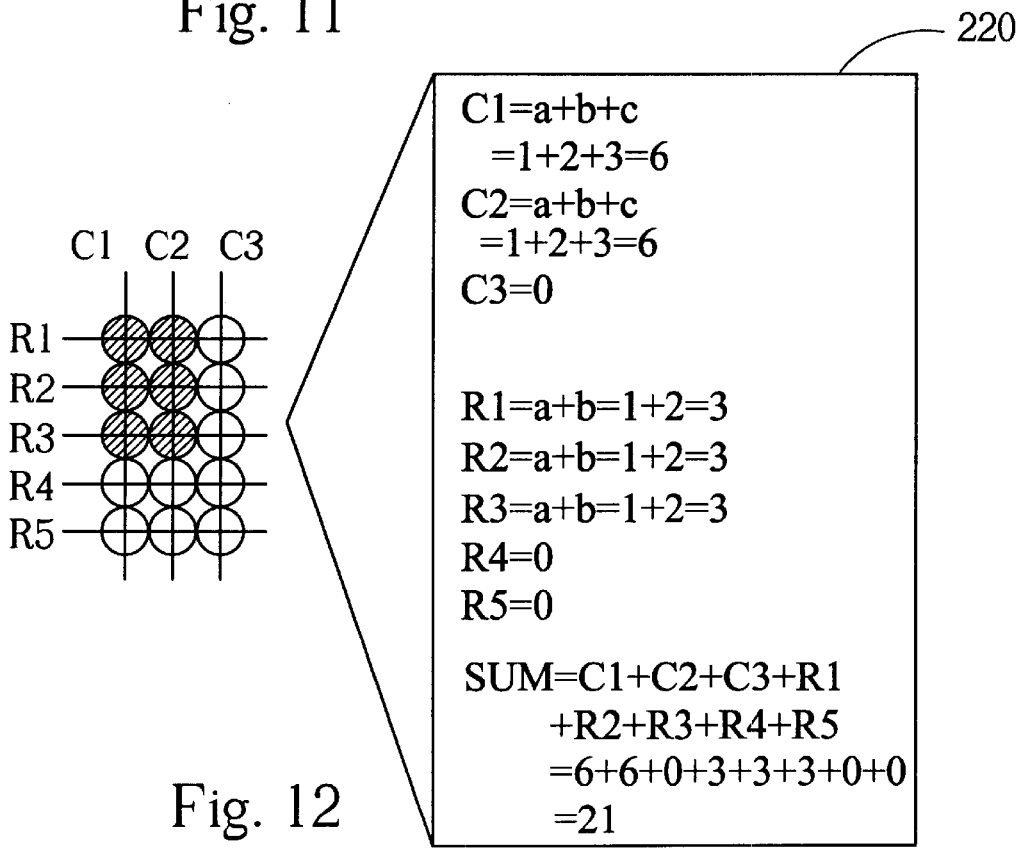
FIG. 12 is a schematic diagram of the total weighting calculation according to the present invention used in a second matrix print head.

In the above embodiment, the present invention is applied to a print head where the nozzles are arranged in a linear manner. Meanwhile, the present invention may also be applied to other print heads where the nozzles are arranged in a matrix or other manners. Please refer to FIG. 11 and FIG. 12. FIG. 11 is a schematic diagram of the total weighting calculation according to the present invention used in a first matrix print head. FIG. 12 is a schematic diagram of the total weighting calculation according to the present invention used in a second matrix print head. To simplify the illustration, only heat-accumulation is considered when calculating the total weight SUM in FIGS. 11 and 12. When nozzles are arranged in a matrix manner, these nozzles can be regarded as composed of a plurality of columns (C1, C2, C3) and a plurality of rows (R1, R2, R3, R4, R5). Nozzles in each column or row can be considered as linearly arranged. Therefore, the weighting calculation procedure in FIG. 7 can be applied. Weighting calculation results of each column and each row are added to generate a total weight SUM as indicated in the calculation procedures 210 and 220 in FIGS. 11 and 12. In FIGS. 11 and 12, the numbers of active nozzles in both embodiments are six. When the active nozzle distribution is dispersed as illustrated in FIG. 11, a smaller total weight SUM, which equals 13, is obtained. When the active nozzle distribution is more concentrated as illustrated in FIG. 12, a larger total weight SUM, which equals 21, is obtained.

Figure 13:
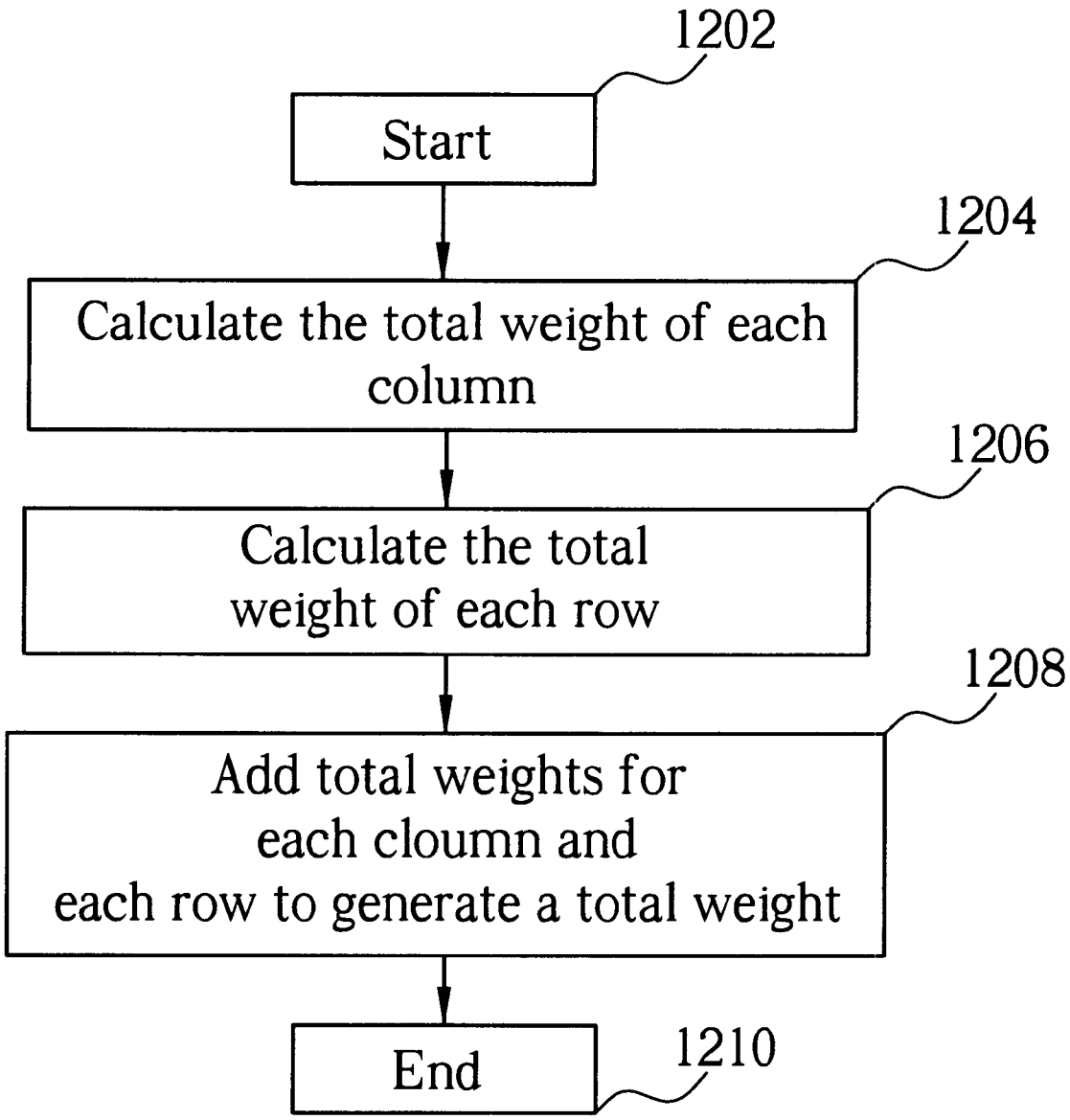
FIG. 13 is a flow chart of the total weighting calculation according to the present invention used in a first matrix print head.

Please refer to FIG. 13. FIG. 13 is a flow chart illustrating the calculation of the total weight SUM in a print head where the nozzles are arranged in a matrix manner. The calculation steps include:

step 1202: start;

step 1204: calculating a heat-accumulation total weight of each column;

step 1206: calculating a heat-accumulation total weight of each row;

step 1208: add up the heat-accumulation total weight of each column and each row to generate a total weight;

step 1210: end.

Figure 14:
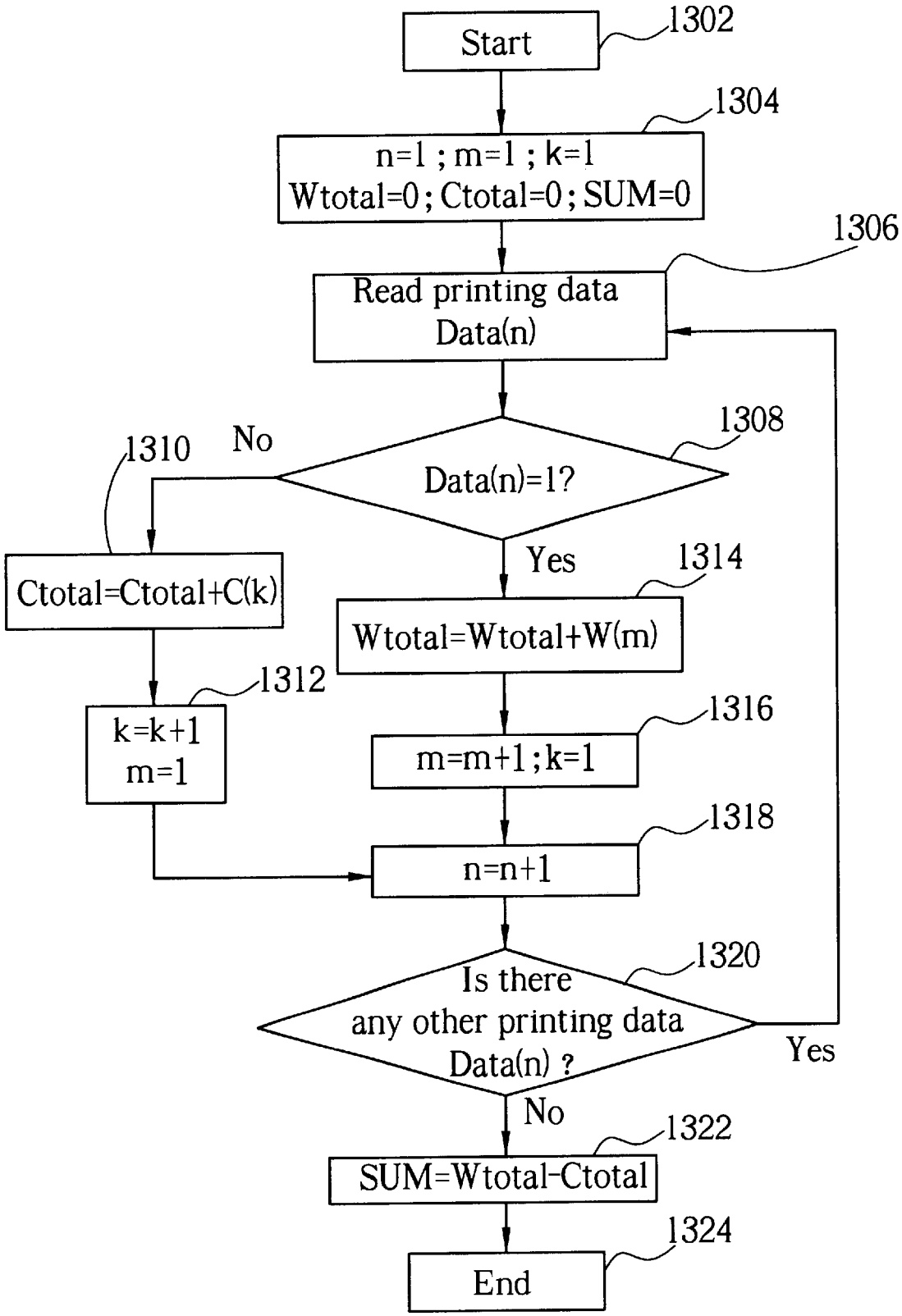
FIG. 14 is a flow chart of the total weighting calculation according to the present invention used in a second matrix print head.

Please refer to FIG. 14. FIG. 14 is a flow chart illustrating the total weight calculation of another embodiment according to the present invention. In addition to the heat-accumulation total weight of the active nozzle, this embodiment considers the heat-dilution total weight of the reserved nozzle as well. The steps include:

step 1302: start;

step 1304: printing data index n set to 1; heat-accumulation index m set to 1; heat-dilution index k set to 1; heat-accumulation total weight Wtotal set to 0; heat-dilution total weight Ctotal set to 0; total weight SUM set to 0;

step 1306: read printing data DATA(n);

step 1308: if DATA(n) is 1, go to step 1314; if not, go to step 1310;

step 1310: according to the heat-dilution weighting table 180 as shown in FIG. 6B, add heat-dilution weighting C(k) to heat-dilution total weight Ctotal;

step 1312: add 1 to heat-dilution index k, set heat-accumulation index m to 1, go to step 1318;

step 1314: add heat-accumulation weighting W(m) to heat-accumulation total weight Wtotal;

step 1316: add 1 to heat-accumulation index m, set heat-dilution index k to 1;

step 1318: add 1 to printing data index n;

step 1320: if there is other printing data, go to step 1306; if not, go to step 1322;

step 1322: subtract heat-dilution total weight Ctotal from heat-accumulation total weight Wtotal and save the difference as total weight SUM, go to step 1324;

step 1324: end.

A simplified example is illustrated below. Assume a print head has eight nozzles arranged in a line, each signal received by the nozzle being expressed as: Data(1), Data(2), Data(3), Data(4), Data(S), Data(6), Data(7) and Data(8).

If the signal received by a nozzle is 1, the nozzle is an active nozzle. If the signal received by a nozzle is 0, the nozzle is a reserved nozzle.

EXAMPLE 1

Data(1)=1;

Data(2)=1;

Data(3)=1;

Data(4)=1;

Data(5)=0;

Data(6)=0;

Data(7)=0;

Data(8)=0.

From the heat-accumulation weighting table 170 in FIG. 6A and the flow chart in FIG. 14:

$$\text{SUM}=W\text{total}-C\text{total}=(a+b+c+d)(A+B+C+D)=(1+2+3+4)(0+1+1+2)=6$$

EXAMPLE 2

Data(1)=0;

Data(2)=1;

Data(3)=1;

Data(4)=0;

Data(5)=0;

Data(6)=1;

Data(7)=1;

Data(8)=0.

From the heat-accumulation weighting table 170 in FIG. 6A and the flow chart in FIG. 14:

$$\text{SUM}=W\text{total}-C\text{total}=(a+b+c+d)(A+B+C+D)=(1+2+1+2)(0+0+1+0)=5$$

EXAMPLE 3

Data(1)=1;

Data(2)=0;

Data(3)=0;

Data(4)=1;

Data(5)=0;

Data(6)=1;

Data(7)=0;

Data(8)=1.

From the heat-accumulation weighting table 170 in FIG. 6A and the flow chart in FIG. 14:

$$SUM=Wtotal-Ctotal=(a+b+c+d)(A+B+C+D)=(1+1+1+1)(0+1+0+0)=3$$

This embodiment considers both the heat-accumulation effect of the active nozzles and the heat-dilution effect of the reserved nozzles, thus the total weight SUM better represents the energy accumulation condition of the nozzles on the print head in this printing process. A better determination of proper pre-heating signals can be achieved.

Figure 15:
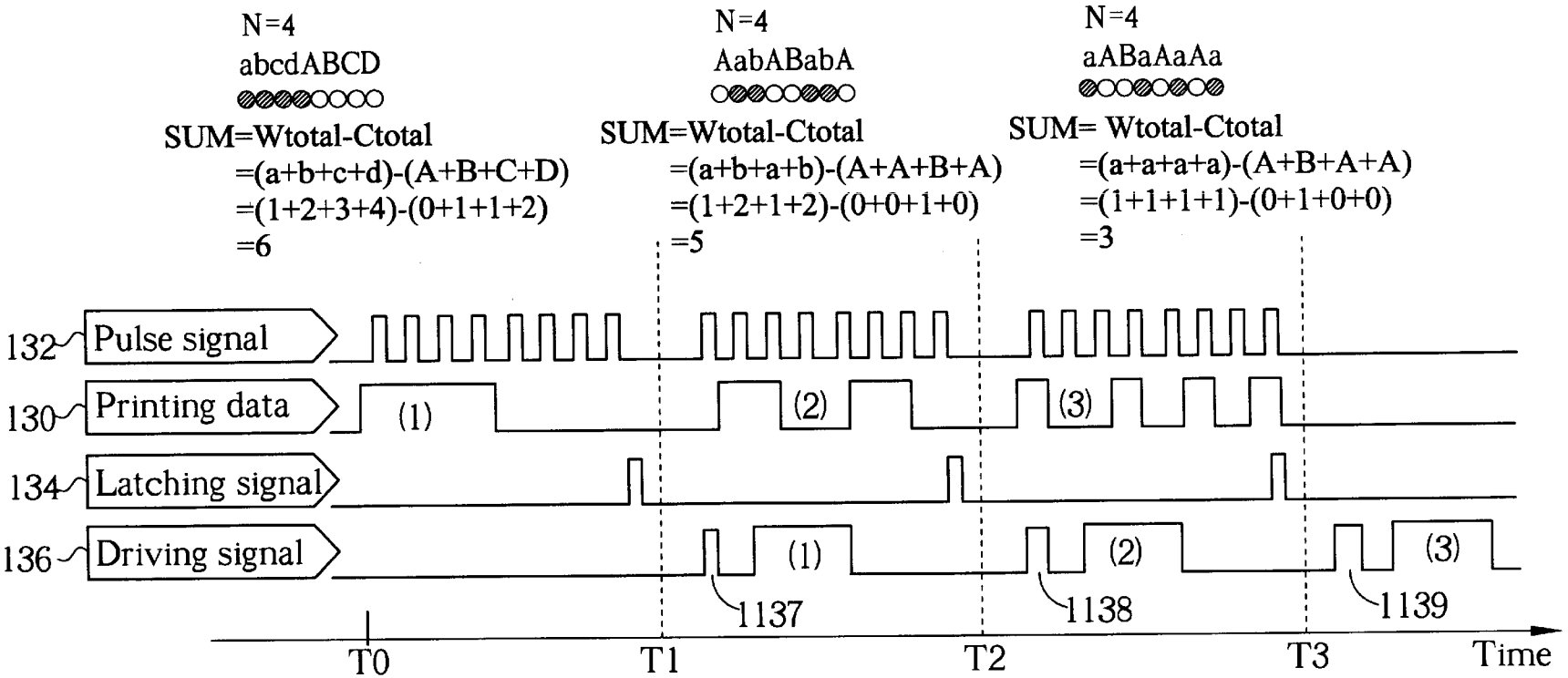
FIG. 15 is a timing diagram of another embodiment of a total weighting calculation according to the present invention.

FIG. 15 is a timing diagram of another embodiment of a total weighting calculation according to the present invention. Printing data 130 in FIG. 15 is the same as that in FIG. 8. However, in this embodiment the weighting calculation module 160 considers both the heat-dilution effect of the reserved nozzles and the heat-accumulation effect of the active nozzles. After the heat-accumulation total weight Wtotal and the heatdilution total weight Ctotal are calculated, the total weight SUM are obtained, which are 6, 5, and 3 respectively. Pre-heating signals in these three conditions are different, represented by pre-heating signals 1137, 1138 and 1139, respectively. The total weight of the first printing data 30 (1, 1, 1, 1, 0, 0, 0, 0) is larger, so the energy level of the pre-heating signal 1137 is smaller. The total weight of the third printing data 30 (1, 0, 0, 1, 0, 1, 0, 1) is smaller, so the energy level of the pre-heating signal 1139 is larger.

Figure 16:
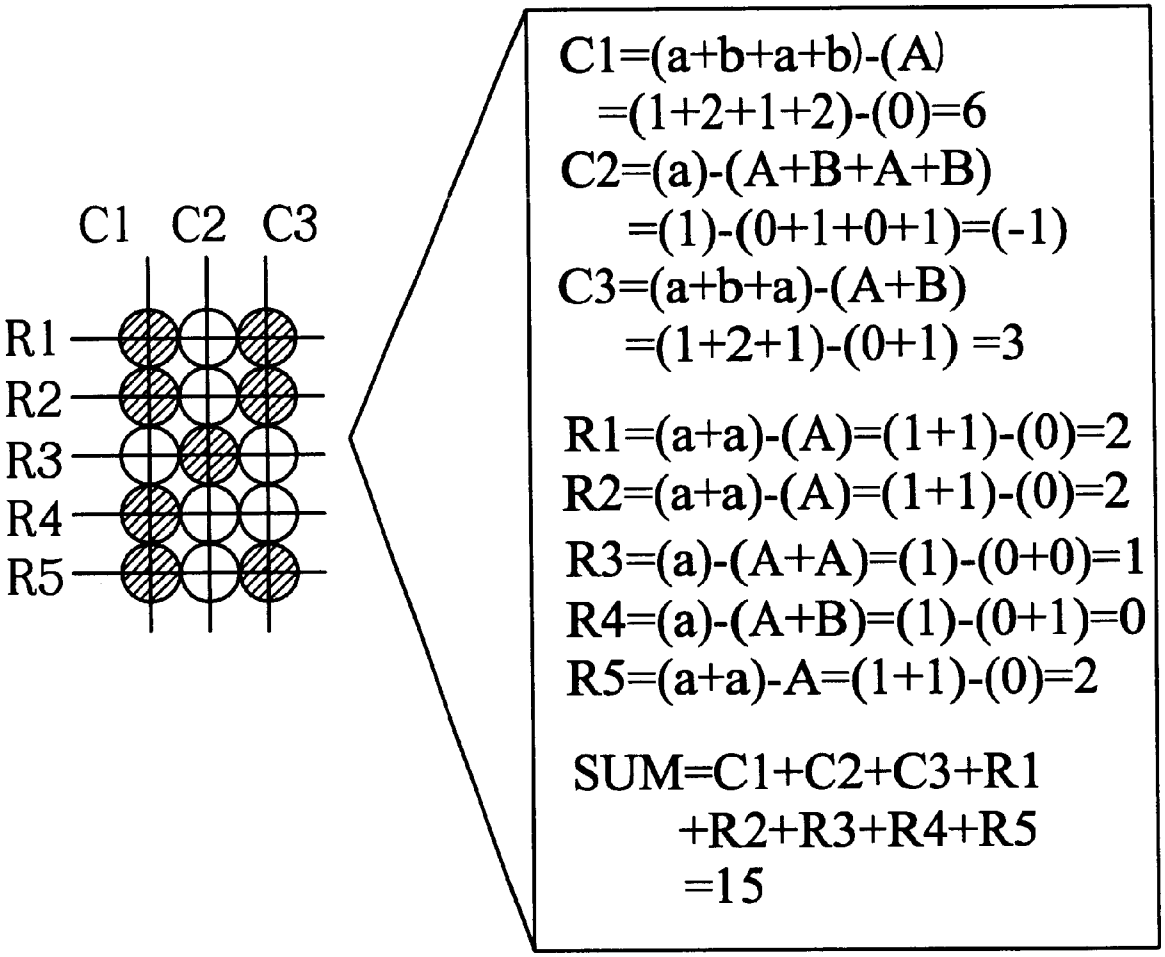
FIG. 16 is a schematic diagram of the total weighting calculation according to the present invention used in a first matrix print head.

Please refer to FIG. 16. FIG. 16 is a schematic diagram illustrating the calculation of the total weight of another embodiment where the print head has nozzles arranged in a matrix manner. As shown, the heat-accumulation total weight of the active nozzles and the heat-dilution total weight of the reserved nozzles are considered when calculating the total weight. The nozzles of the print head can be divided into a plurality of columns (C1, C2, C3) and a plurality of rows (R1, R2, R3, R4, R5). Each column and row can be respectively considered as nozzles arranged in a linear manner, and the total weight of each column and row are calculated as indicated in FIG. 14. The total weights of all columns and rows are added up to generate a total weight SUM.

Since the total weight is defined by subtracting the heat-dilution total weight Ctotal of all reserved nozzles from the heat-accumulation total weight Wtotal of all active nozzles (SUM=Wtotal−Ctotal), the value of SUM may be negative. This will not cause any problem if SUM is divided into several ranges for determining a proper pre-heating signal. For example, if SUM<=0, a first pre-heating signal is used; if 0<SUM<=10, a second pre-heating signal is used; if 10<SUM<=20, a third preheating signal is used; if 20<SUM, a fourth pre-heating signal is used. The first, the second, the third, and the fourth pre-heating signals may have different pulse durations or voltage levels to provide different energy levels to the ink in the ink chamber so as to jet ink drops out of the nozzles on the print head.

Previously mentioned calculation modules can be used to calculate and evaluate the heat accumulation effect of the print head, thus these can substitute for the calculation method illustrated in steps 910 and 918 shown in FIG. 10, depending on the actual applications.

The control procedure according to the present invention utilizes the temperature of the print head measured by the thermometer 190 and the total weight calculation method previously described to calculate the thermal energy accumulation condition of the print head. Then, the control circuit can determine whether or not to apply a pre-heating signal to all active nozzles in this printing process or can decide to apply a pre-heating signal with an appropriate pulse duration or an appropriate level of voltage. Nevertheless, all active nozzles still receive the same pulses in one printing process.

Therefore, an alternative control procedure is provided to count the number of active nozzles adjacent to a specific active nozzle to calculate a heat-accumulation weighting (W) of the specific active nozzle. For example, a nozzle in a matrix print head normally has eight adjacent nozzles. When there are five active nozzles among the eight adjacent nozzles, the heat-accumulation weighting W of the specific active nozzle is 5. When there are two active nozzles among the eight adjacent nozzles, the heat-accumulation weighting W of the specific active nozzle is 2. That is to say, a greater number of active nozzles adjacent to an active nozzle corresponds to a higher heat-accumulation weighting of the specific active nozzle. In contrast, a smaller number of active nozzles adjacent to an active nozzle corresponds to a lower heat-accumulation weighting of the specific active nozzle.

Please refer to FIG. 5. To apply the above mentioned control procedure, the memory 150 in the control circuit 100 includes a reference temperature (Tr) 192 and a reference heat-accumulation weighting (Wr1, Wr2) 196. The process 140 compares the temperature (T) measured by the thermometer 190 with the reference temperature (Tr) 192 and compares the heat-accumulation weighting (W) of a nozzle with the reference heat-accumulation weighting (Wr1, Wr2) 196 to determine whether or not to generate a pre-heating signal or to determine a pulse duration or a level of voltage. The reference temperature (Tr) 192 and the reference heat-accumulation weighting (Wr1, Wr2) 196 can be set or reset depending on the actual requirement, such as Tr=50° C., Wr1=6, and Wr2=4.

Figure 17:
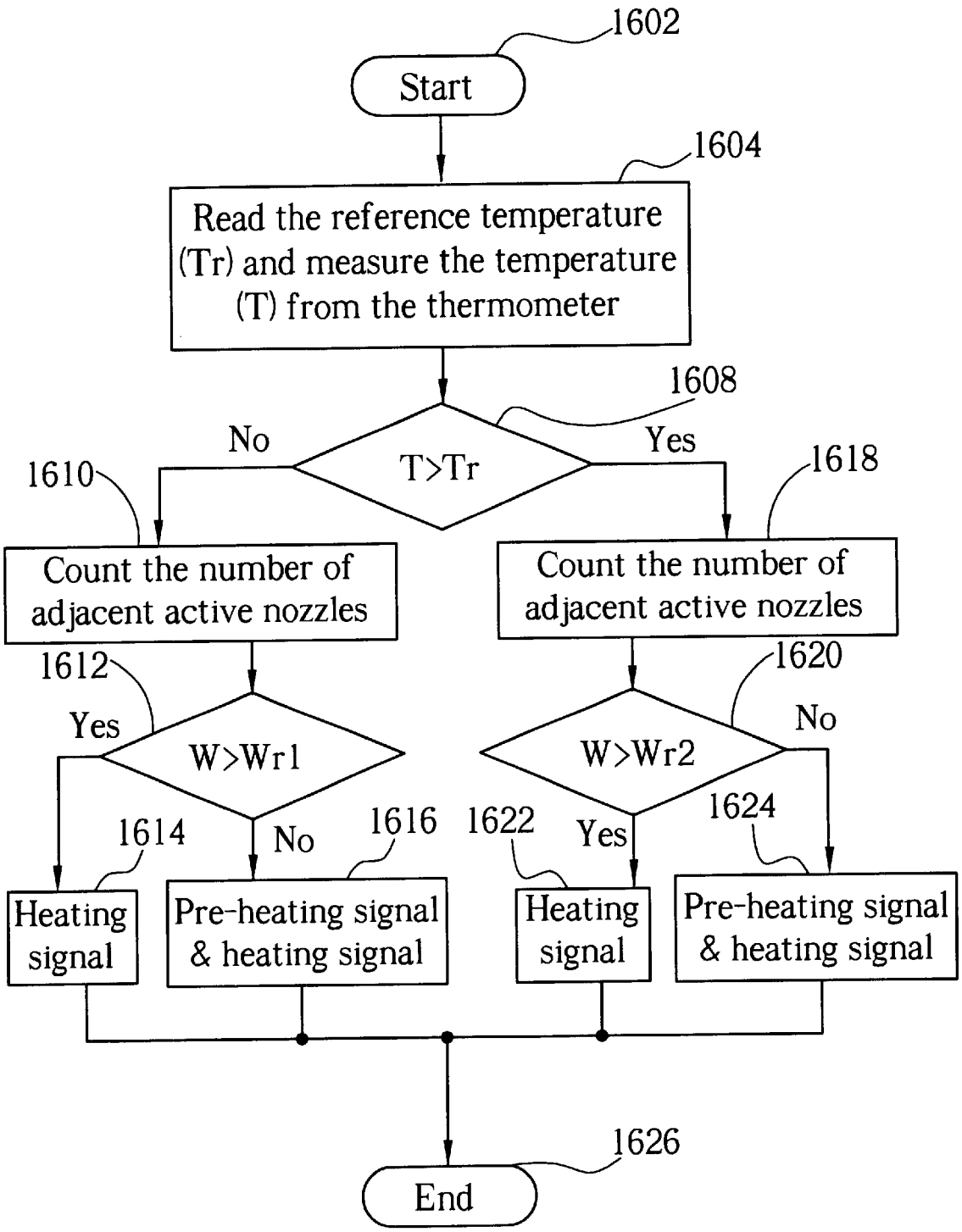
FIG. 17 is a flow chart of a second control procedure according to the present invention.

Please refer to FIG. 17. FIG. 17 is a flow chart of a second control procedure according to the present invention. This flow chart is illustrated below:

step 1602: start;

step 1604: read a default reference temperature (Tr) in the memory 150, and measure a temperature (T) of the ink chamber in the print head by a thermometer 190;

step 1608: if the measured temperature is higher than the reference temperature (T>Tr), go to step 1610, if not, go to step 1618;

step 1610: count the number of active nozzles adjacent to a specific active nozzle to determine a heat-accumulation weighting (W) of the specific active nozzle;

step 1612: if the heat-accumulation weighting (W) is larger than the first reference heat-accumulation weighting (Wr1), go to step 1614, if not, go to 1616;

step 1614: apply a driving signal containing a heating signal only, go to step 1626;

step 1616: apply a driving signal containing a pre-heating signal and a heating signal, go to step 1626;

step 1618: count the number of active nozzles adjacent to a specific active nozzle to determine a heat-accumulation weighting (W) of the specific active nozzle;

step 1620: if the heat-accumulation weighting (W) is larger than the second reference heat-accumulation weighting (Wr2), go to step 1622, if not, go to 1624;

step 1622: apply a driving signal containing a heating signal only, go to step 1626;

step 1624: apply a driving signal containing a pre-heating signal and a heating signal;

step 1626: end.

For simplicity, the heat-accumulation weighting (W) is simply divided into two sections according to the control procedure shown in FIG. 17 to determine whether or not to apply a pre-heating signal. The heat-accumulation weighting (W) may also be divided into several sections for transmitting proper pre-heating signals with different pulse durations or different levels of voltage to the driving module 126 so as to provide an appropriate amount of energy to the heating elements of the ink chamber.

As described above, the control procedure utilizes the number of active nozzles adjacent to a specific active nozzle to calculate a heat-accumulation weighting (W). Thereafter, the control circuit can compare the heat-accumulation weighting (W) of the specific active nozzle with the reference heat-accumulation weightings (Wr1, Wr2) stored in the memory 150 to determine whether or not to apply a pre-heating signal or to determine a pulse duration or a level of voltage of a pre-heating signal. Nevertheless, the control circuit of the present invention can also utilize a simpler calculation procedure to determine whether or not to generate a pre-heating signal. According to this control procedure, the determination of applying a pre-heating signal is decided by the number of active nozzles adjacent to the specific active nozzle. The description of the above-mentioned embodiments has been simplified for clarity. In fact, the control circuit of the print head outputs a plurality of driving signals for each active nozzle so as to heat up the corresponding ink chamber according to the respective driving signal. In addition, the previously mentioned temperature compensation methods according to the present invention are still suitable in these embodiments.

Furthermore, the control circuit of the present invention can also be used to determine whether a pre-heating signal is required for an active nozzle in a printing process.

Figure 18:
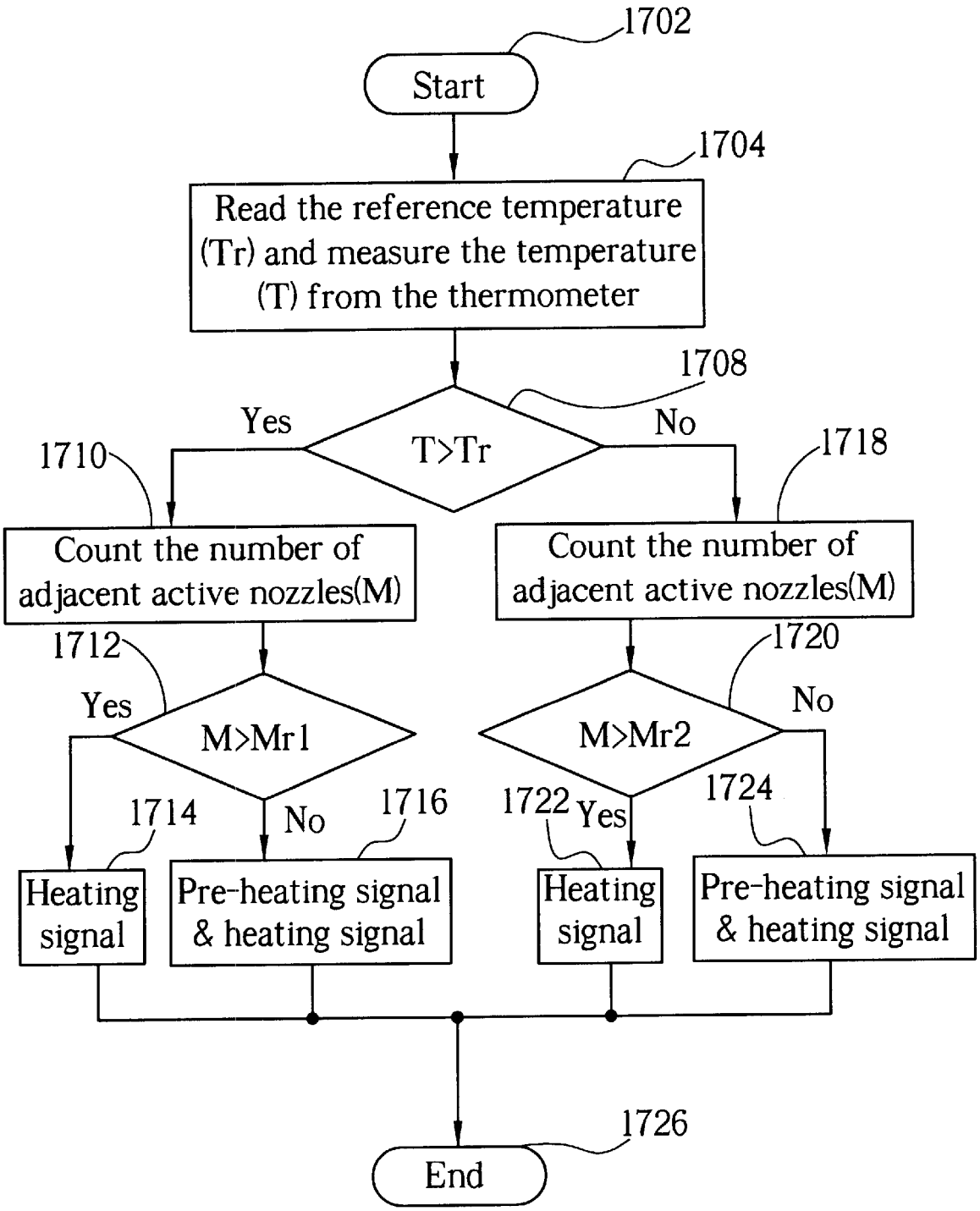
FIG. 18 is a flow chart of a third control procedure according to the present invention.

Please refer to FIG. 18. FIG. 18 is a flow chart of a third control procedure according to the present invention. The control procedure utilizes the number of active nozzles adjacent to a specific active nozzle to determine whether or not to apply a pre-heating signal to the specific active nozzle. This flow chart is illustrated below:

step 1702: start;

step 1704: read a default reference temperature (Tr) in the memory 150, and measure a temperature (T) of the ink chamber in the print head by a thermometer 190;

step 1708: if the measured temperature is higher than the reference temperature (T>Tr), go to step 1710, if not, go to step 1718;

step 1710: count the number of active nozzles (M) adjacent to a specific active nozzle;

step 1712: if the number of active nozzles (M) is greater than a first reference number of active nozzles (Mr1), go to step 1714, if not, go to 1716;

step 1714: apply a driving signal containing a heating signal only, go to step 1726;

step 1716: apply a driving signal containing a pre-heating signal and a heating signal, go to step 1726;

step 1718: count the number of active nozzles (M) adjacent to a specific active nozzle;

step 1720: if the number of active nozzles (M) is greater than a second reference number of active nozzles (Mr2), go to step 1722, if not, go to 1724;

step 1722: apply a driving signal containing a heating signal only, go to step 1726;

step 1724: apply a driving signal containing a pre-heating signal and a heating signal;

step 1726: end.

Figure 19:
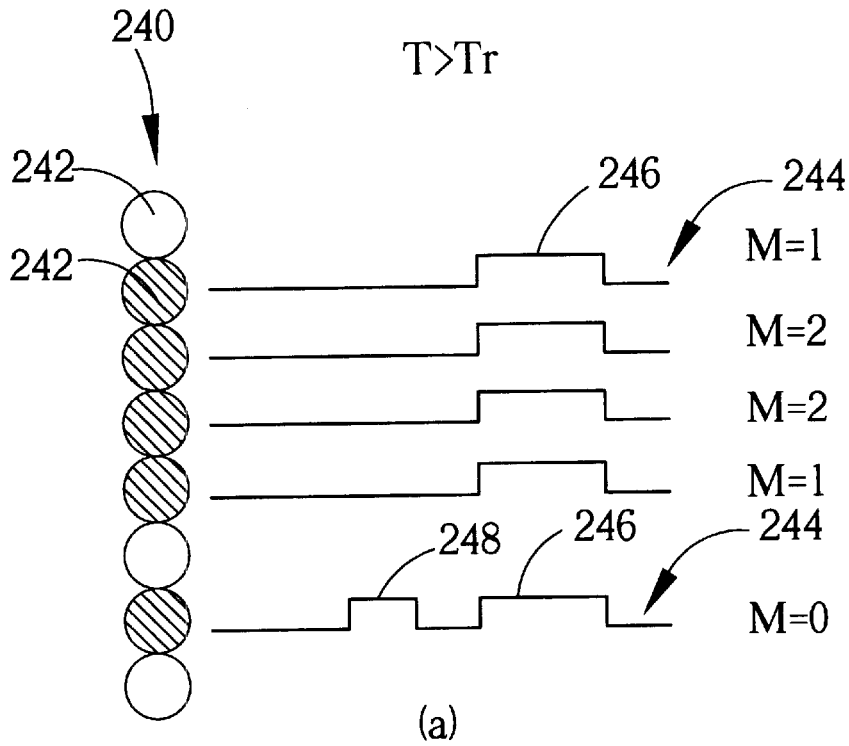
FIG. 19 is a schematic diagram of driving signals under conditions of various ink chamber temperatures and various distributions of nozzles according to the third control procedure.
Figure 19:
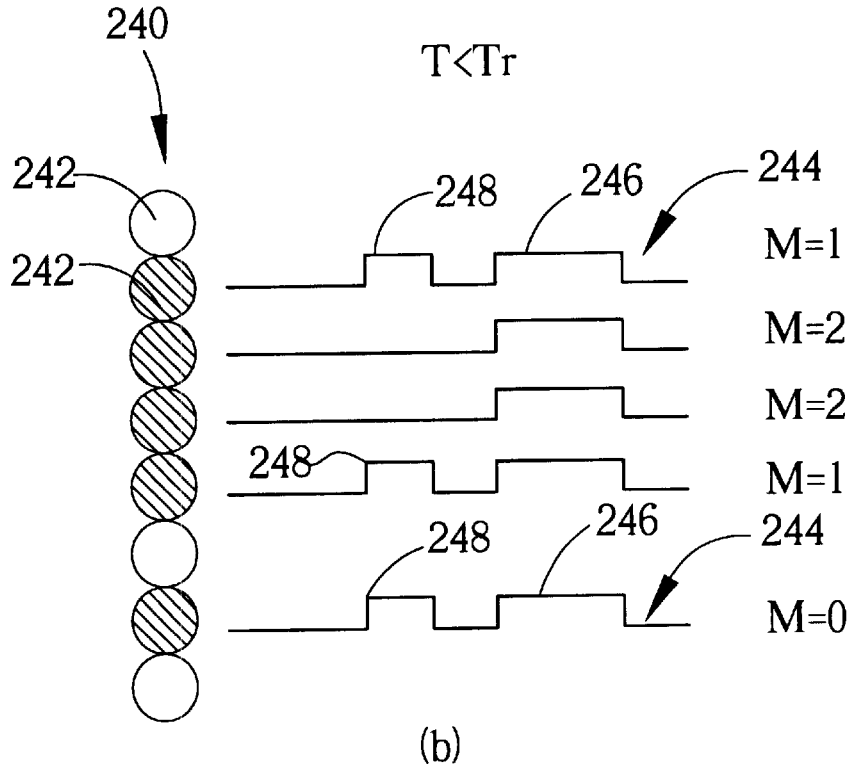

As previously described, the control circuit 100 of the print head outputs a plurality of driving signals instead of only one driving signal so as to heat up the corresponding ink chamber according to the respective driving signal. Please refer to FIG. 19 for a detailed description. FIG. 19 is a schematic diagram of driving signals 244 under conditions of various ink chamber temperatures (T) and various distributions of nozzles 242 according to the third control procedure. For easier understanding of this embodiment, a simplified example is given below. Assume the first reference number of nozzles (Mr1) is 0 and the second reference number of nozzles (Mr2) is 1. The print head 240 has eight nozzles 242 arranged in a line, and driving signals 244 received by each nozzle 242 are respectively expressed by Data(1), Data(2), Data(3), Data(4), Data(5), Data(6), Data (7), and Data(8). Each driving signal 244 in FIG. 19 corresponds to a nozzle 242 located on its left side. If the driving signal received by a nozzle is 1, the nozzle is an active nozzle. If the driving signal received by a nozzle is 0, the nozzle is a reserved nozzle. In this example: Data(1)=0, Data(2)=1, Data(3)=1, Data(4)=1, Data(5)=1, Data(6)=0, Data(7)=1, and Data(8)=0.

The control circuit 100 determines the driving signal 244 according to the number of the adjacent active nozzles of each active nozzle 242. As shown in (a) of FIG. 19, when the measured temperature is higher than the reference temperature (T>Tr), and if the number of adjacent active nozzles is greater than 0 (M>Mr1), the driving signal 244 merely comprises a heating signal 246. And if the number of adjacent active nozzles is not greater than 0 (M<=Mr1), the driving signal 244 comprises a pre-heating signal 248 and a heating signal 246. As shown in (b) of FIG. 19, when the measured temperature is lower than the reference temperature (T<Tr), and if the number of adjacent active nozzles is greater than 1(M>Mr2), the driving signal 244 merely comprises a heating signal 246. And if the number of adjacent active nozzles is not greater than 1(M<=Mr2), the driving signal 244 comprises a pre-heating signal 248 and a heating signal 246. Consequently, the control circuit 100 outputs the driving signal 244 to the active nozzle 242 according to measured temperature and the number of the adjacent active nozzles of each active nozzle 242 so as to provide uniform ink spots.

Figure 20:
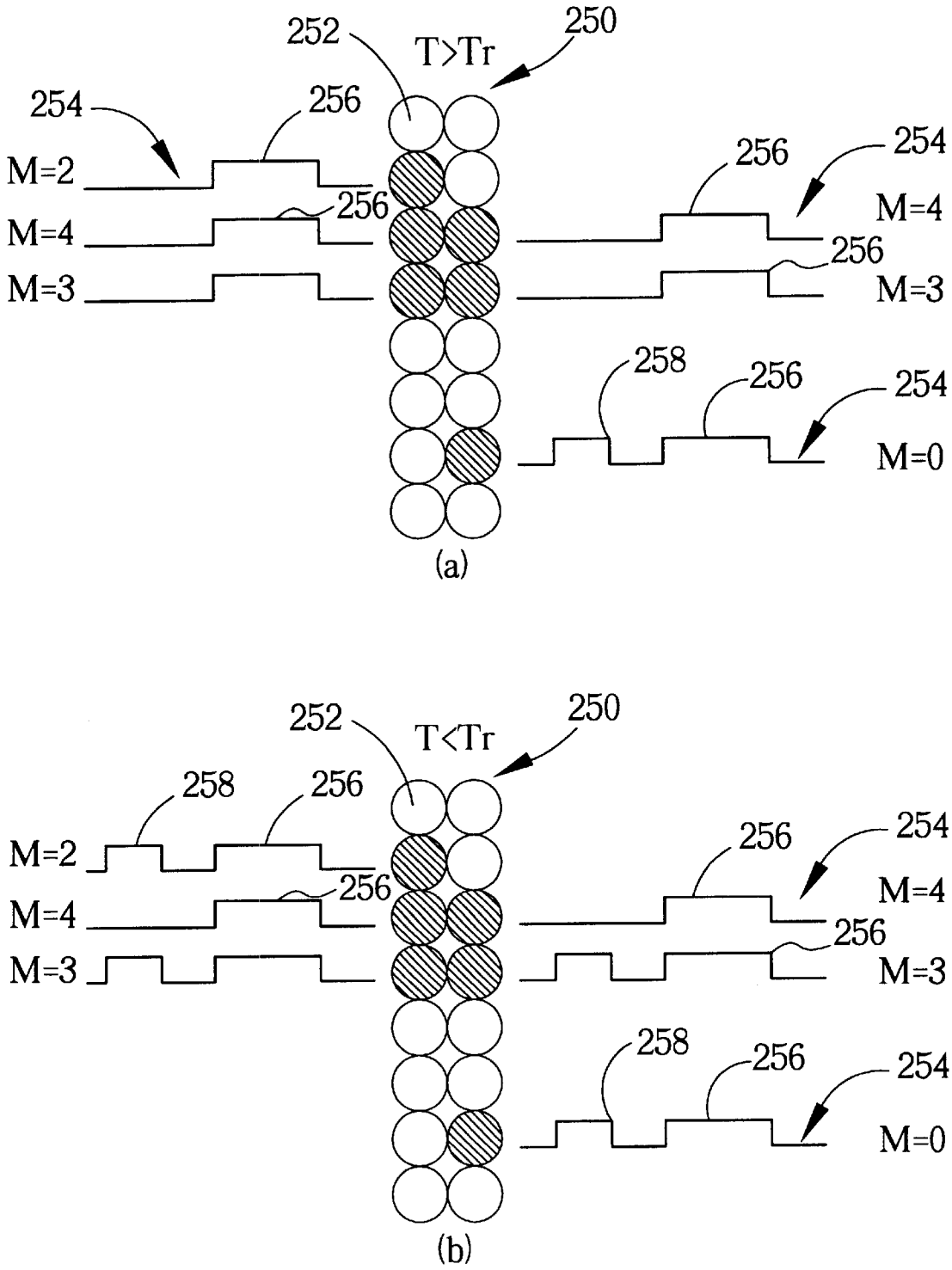
FIG. 20 is a schematic diagram of driving signals under conditions of various ink chamber temperatures and various distributions of nozzles according to the third control procedure used in a matrix print head.

Please refer to FIG. 20. FIG. 20 is a schematic diagram of driving signals 254 under conditions of various ink chamber temperatures (T) and various distributions of nozzles 252 according to the third control procedure used in a matrix print head 250. For easier understanding of this embodiment, a simplified example is given below. Assume the first reference number of nozzles (Mr1) is 1 and the second reference number of nozzles (Mr2) is 3. The print head 250 has sixteen nozzles 252 arranged in two lines, driving signals 254 received by each nozzle 252 in the first column are expressed by Data(1,1), Data(1,2), Data(1,3), Data(1,4), Data(1,5), Data(1,6), Data(1,7), and Data(1,8). And driving signals 254 received by each nozzle 252 in the second column are expressed by Data(2,1), Data(2,2), Data (2,3), Data(2,4), Data(2,5), Data (2,6), Data(2,7), and Data (2,8). Each driving signal 254 in FIG. 20 corresponds to a nozzle 252 adjacent to it. If the driving signal received by a nozzle is 1, the nozzle is an active nozzle. If the driving signal received by a nozzle is 0, the nozzle is a reserved nozzle. For example: Data(1,1)=0, Data(1,2)=1,Data(1,3)=1, Data(1,4)=1, Data(1,5)=0, Data(1,6)=0,Data(1,7)=0,Data (1,8)=0,Data(2,1)=0,Data(2,2)=0,Data(2,3)=1,Data(2,4)=1, Data(2,5)=0,Data(2,6)=0,Data(2,7)=1, andData(2,8)=0. The control circuit determines the driving signal 254 according to the number of the adjacent active nozzles of each active nozzle 252. As shown in (a) of FIG. 20, when the measured temperature is higher than the reference temperature (T>Tr), and if the number of adjacent active nozzles is greater than 1 (M>Mr1), the driving signal 254 merely comprises a heating signal 256. And if the number of adjacent active nozzles is not greater than 1 (M<=Mr1), the driving signal 254 comprises a pre-heating signal 258 and a heating signal 256. As shown in (b) of FIG. 20, when the measured temperature is lower than the reference temperature (T<Tr), and if the number of adjacent active nozzles is greater than 3 (M>Mr2), the driving signal 254 merely comprises a heating signal 256. And if the number of adjacent active nozzles is not greater than 3 (M<=Mr2), the driving signal 254 comprises a pre-heating signal 258 and a heating signal 256. Consequently, the control circuit outputs the different driving signal 254 to the active nozzle 242 according to the number of the adjacent active nozzles of each active nozzle 252 so as to provide uniform ink spots.

Figure 21:
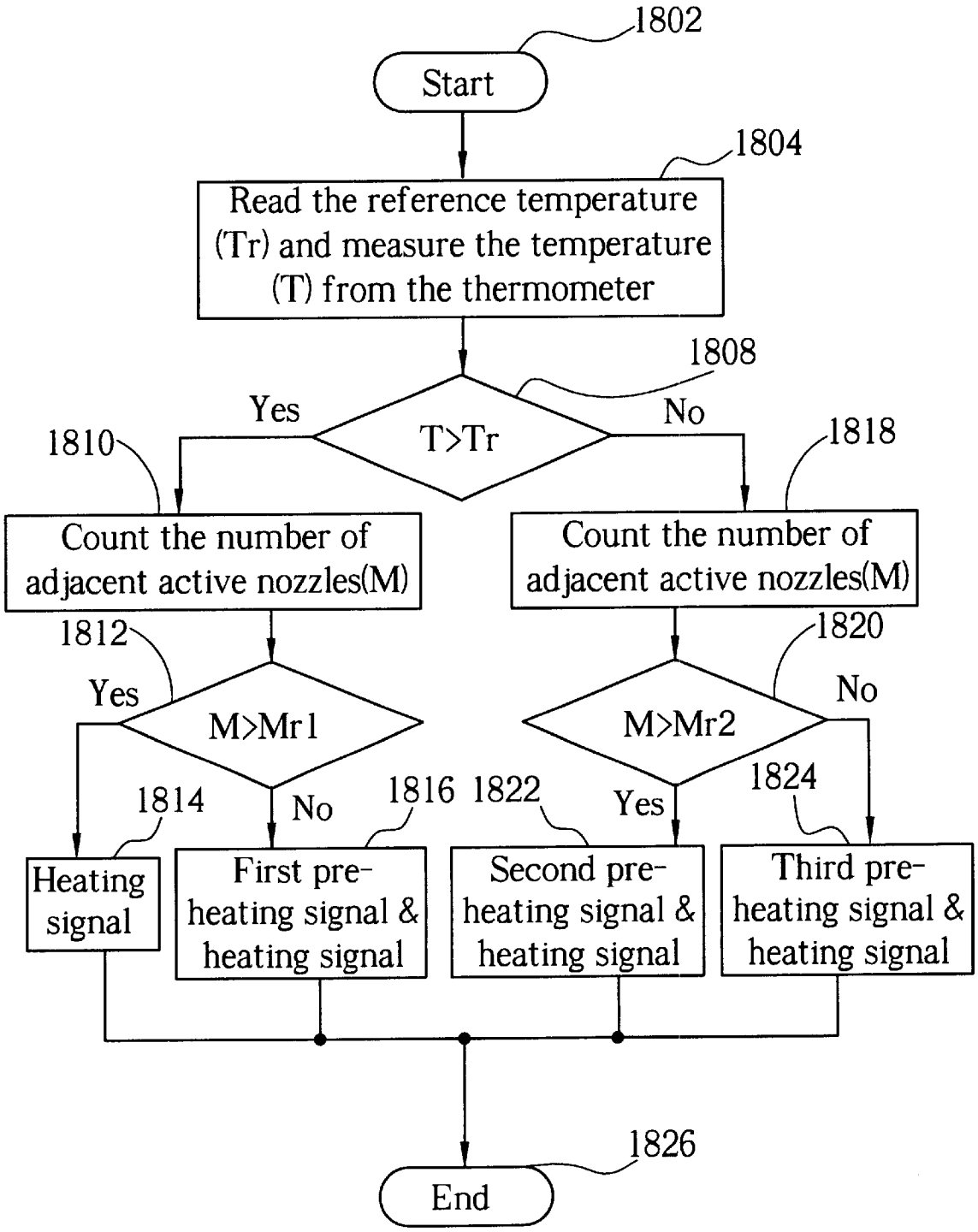
FIG. 21 is a flow chart of a fourth control procedure according to the present invention.

Please refer to FIG. 21. FIG. 21 is a flow chart of a fourth control procedure according to the present invention. The fourth control procedure utilizes the number of active nozzles adjacent to a specific active nozzle to determine whether or not to generate a pre-heating signal and to determine a pulse duration of the pre-heating signal. This flow chart is illustrated below:

step 1802: start;

step 1804: read a default reference temperature (Tr) in the memory 150, and measuring a temperature (T) of the ink chamber in the print head by a thermometer 190;

step 1808: if the measured temperature is higher than the reference temperature (T>Tr), go to step 1810, if not, go to step 1818;

step 1810: count the number of active nozzles (M) adjacent to a specific active nozzle;

step 1812: if the number of active nozzles (M) is greater than a first reference number of active nozzles (Mr1), go to step 1814, if not, go to 1816;

step 1814: apply a driving signal containing a heating signal only, go to step 1826;

step 1816: apply a driving signal containing a first pre-heating signal and a heating signal, go to step 1826;

step 1818: count the number of active nozzles (M) adjacent to a specific active nozzle;

step 1820: if the number of active nozzles (M) is greater than a second reference number of active nozzles (Mr2), go to step 1822, if not, go to 1824;

step 1822: apply a driving signal containing a second pre-heating signal and a heating signal, go to step 1826;

step 1824: apply a driving signal containing a third pre-heating signal and a heating signal;

step 1826: end.

Figure 2:
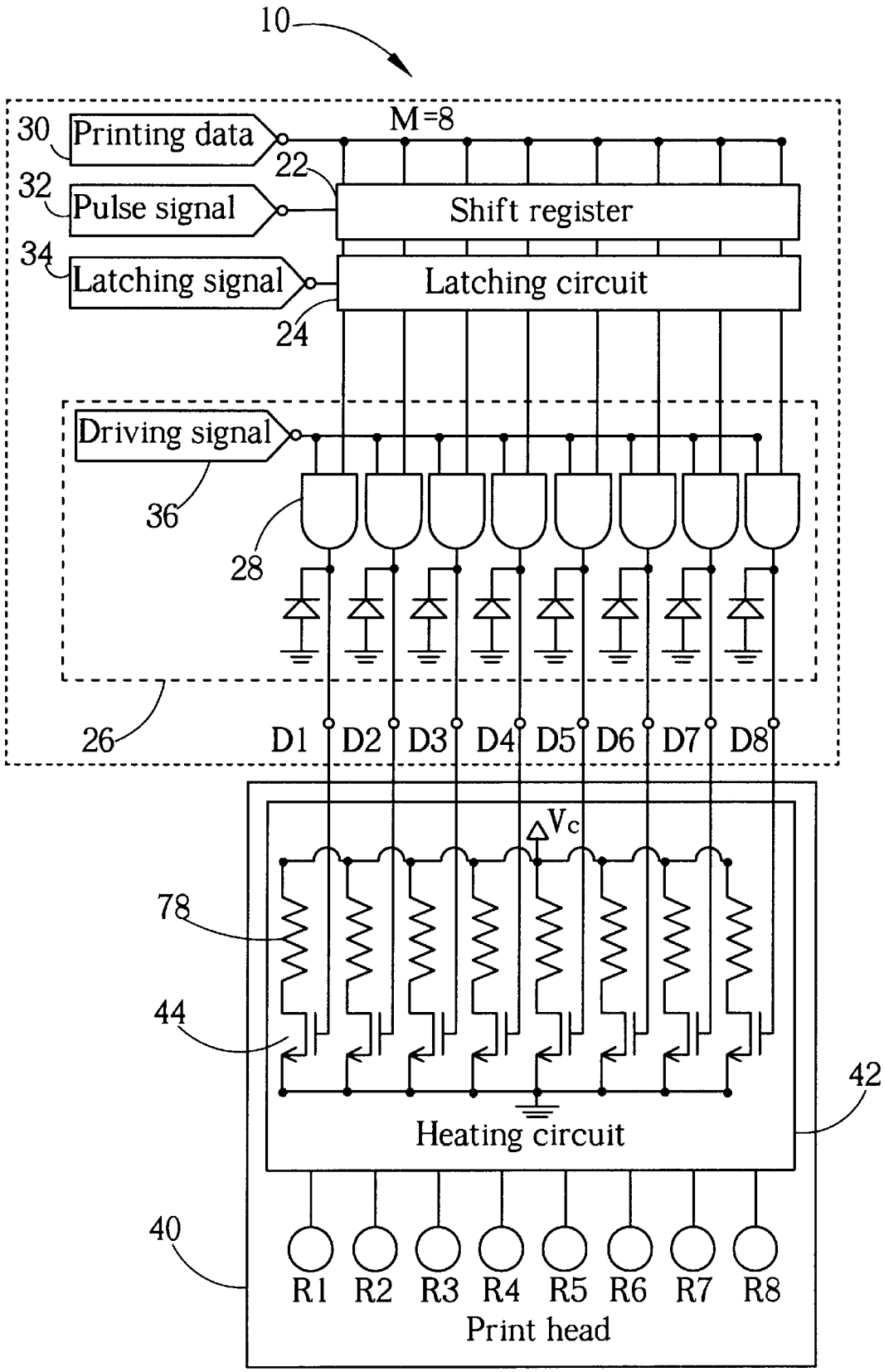
Fig. 2 Prior art
FIG. 2 is a schematic diagram of a driving circuit in a prior art print head.
Figure 3:
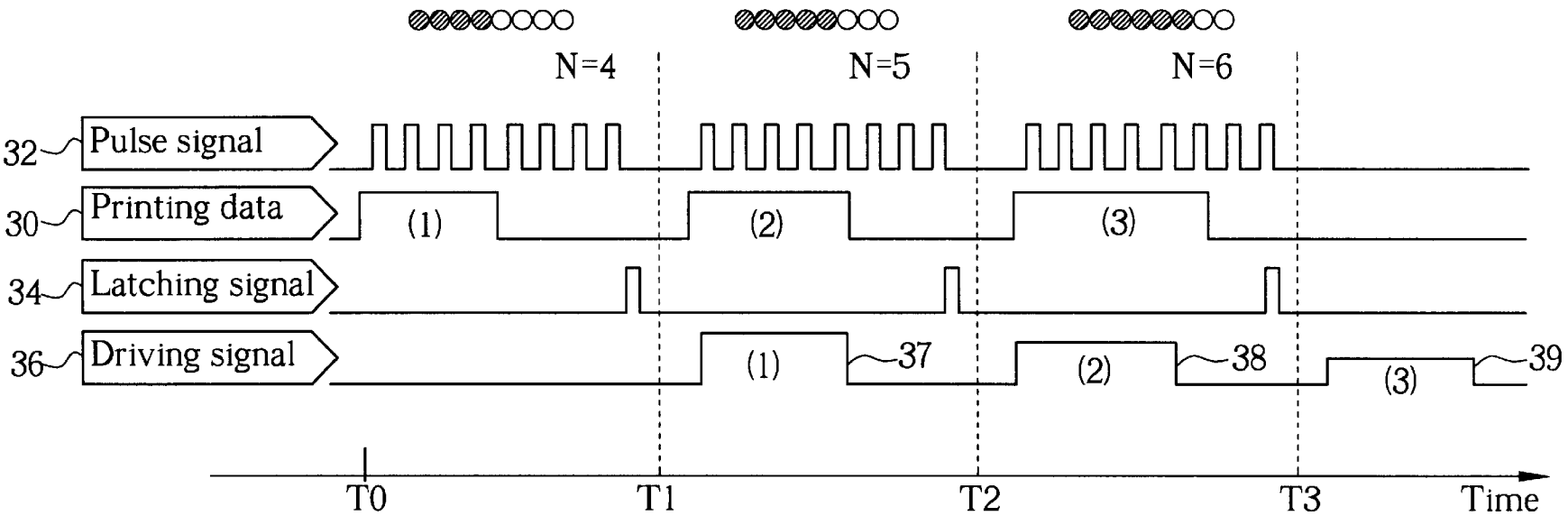
Fig. 3 Prior art
FIG. 3 is a timing diagram of a first driving signal of a prior art print head.
Figure 4:
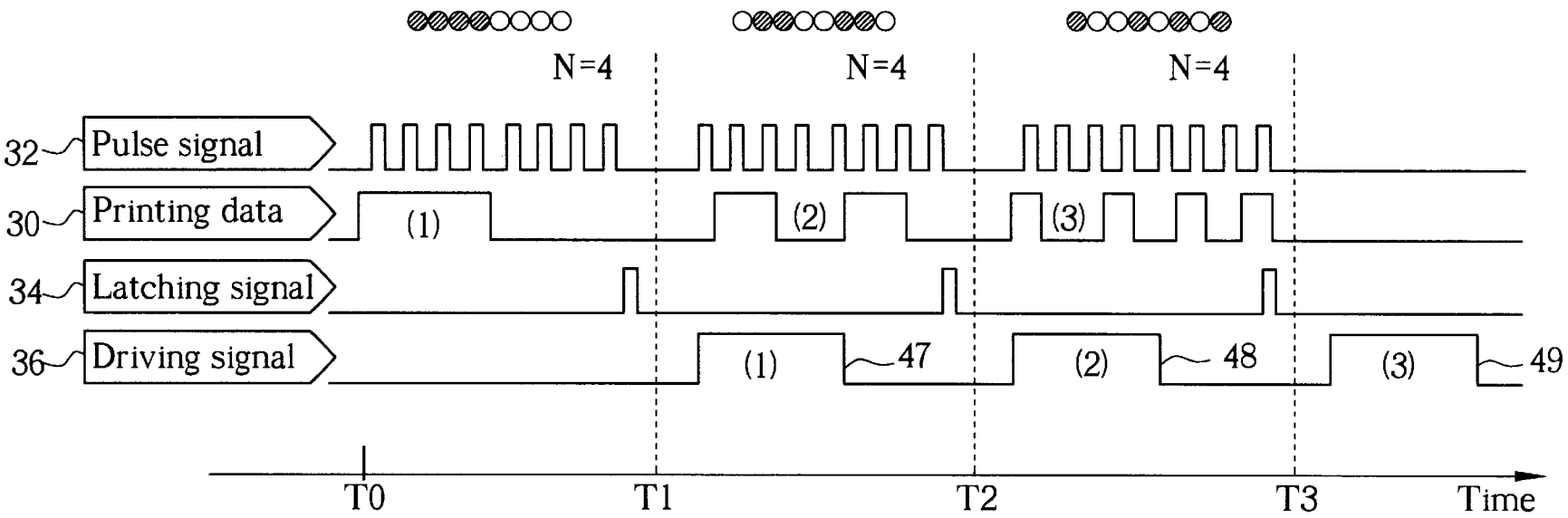
Fig. 4 Prior art
FIG. 4 is a timing diagram of a second driving signal of a prior art print head.
Figure 22:
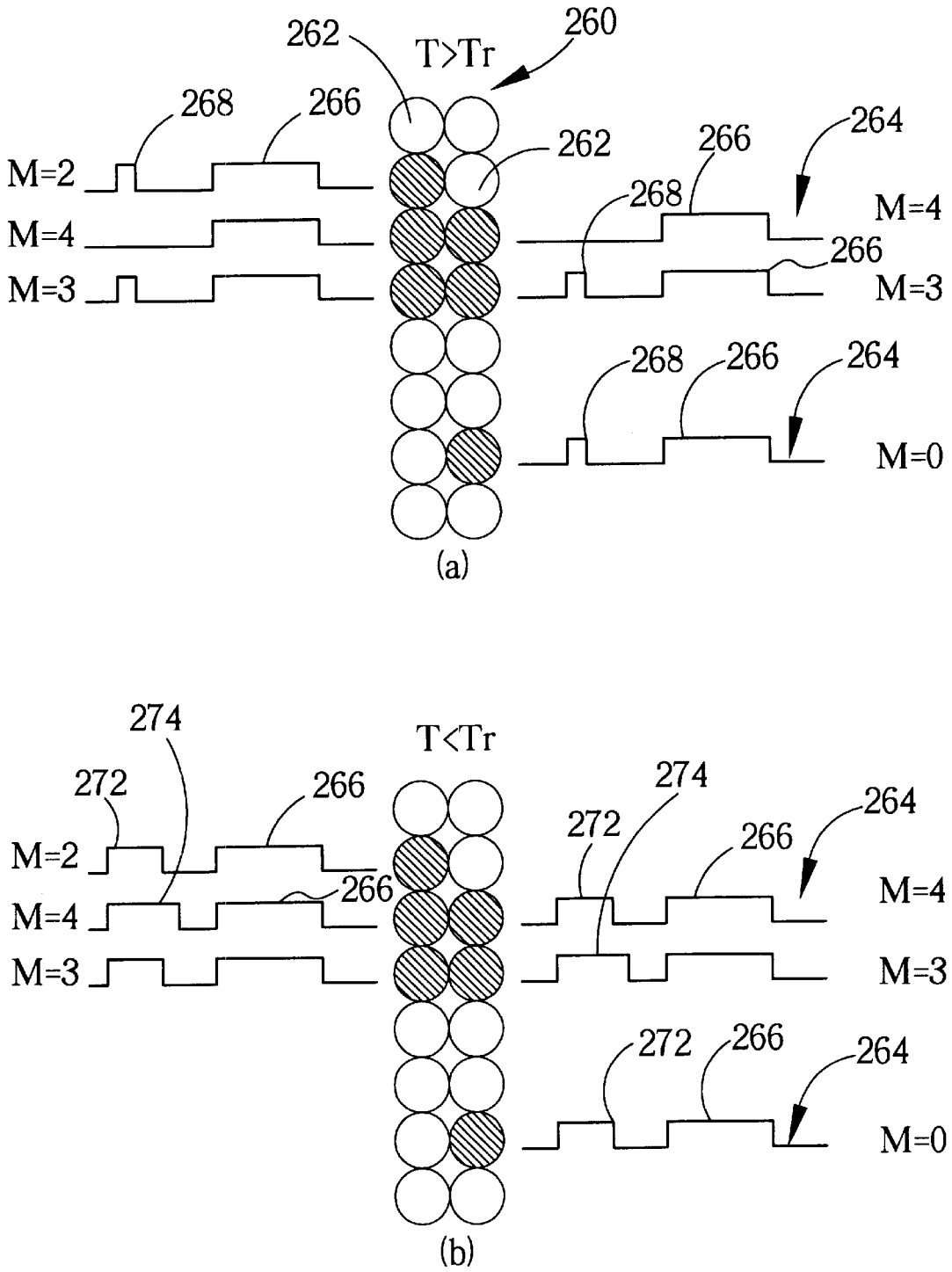
FIG. 22 is a schematic diagram of driving signals under conditions of various ink chamber temperatures and various distributions of nozzles according to the fourth control procedure used in a matrix print head.

Please refer to FIG. 22. FIG. 22 is a schematic diagram of driving signals 264 under conditions of various ink chamber temperatures (T) and various distributions of nozzles 262 according to the fourth control flow used in a matrix print head 260. For easier understanding of this embodiment, a simplified example is given below. Assume the first reference number of active nozzles (Mr1) is 1 and the second reference number of active nozzles (Mr2) is 3. Additionally, a width of the first pre-heating signal 268 is narrower than a width of the second pre-heating signal 272, and the width of the second pre-heating signal 272 is even narrower than a width of the third pre-heating signal 274. The matrix print head 260 has sixteen nozzles 262 arranged in two lines, driving signals 264 received by each nozzle 262 in the first column are expressed by Data(1,1), Data(1,2), Data(1,3), Data(1,4), Data(1,5), Data (1,6), Data(1,7), and Data(1,8). And driving signals 264 received by each nozzle 262 in the second column are expressed by Data(2,1), Data(2,2), Data (2,3), Data(2,4), Data (2,5), Data(2,6), Data(2,7), and Data (2,8). Each driving signal 264 in FIG. 2 corresponds to an active nozzle 262 adjacent to it. If the driving signal received by a nozzle is 1, the nozzle is an active nozzle. If the driving signal received by a nozzle is 0, the nozzle is a reserved nozzle. For example: Data(1,1)=0, Data(1,2)=1,Data(1,3)= 1, Data (1,4)=1, Data(1,5)=0, Data(1,6)=0,Data(1,7)=0,Data (1,8)=0,Data(2,1)=0,Data(2,2) =0,Data(2,3)=1,Data(2,4)=1, Data(2,5)=0,Data(2,6)=0,Data(2,7)=1, andData(2,8)=0. The control circuit determines the driving signal 264 according to the number of the adjacent active nozzles of each active nozzle 262. As shown in (a) of FIG. 22, when the measured temperature is higher than the reference temperature (T>Tr), if the number of adjacent active nozzles is greater than 1 (M>Mr1), the driving signal 264 merely comprises a heating signal 266. And if the number of adjacent active nozzles is not greater than 1 (M<=Mr1), the driving signal 264 comprises a first pre-heating signal 268 and a heating signal 266. As shown in (b) of FIG. 22, when the measured temperature is lower than the reference temperature (T<Tr), and if the number of adjacent active nozzles is greater than 3 (M>Mr2), the driving signal 264 comprises a second pre-heating signal 272 and a heating signal 266. And if the number of adjacent active nozzles is not greater than 3 (M<=Mr2), the driving signal 264 comprises a third pre-heating signal 274 and a heating signal 266. Furthermore, since the width of the first pre-heating signal 268 is narrower than the width of the second pre-heating signal 272, and since the width of the second pre-heating signal 272 is also narrower than the width of the third pre-heating signal 274, the distribution of the heat accumulation effect in the ink chamber can be uniformed so as to jet the ink drops with the same size from the nozzle 262. Moreover, in addition to the various widths of the pulse durations of the pre-heating signals, other types of pre-heating signals with different energy levels can be used in the present invention. For example, pre-heating signals with the same widths of the pulse durations but different levels of voltage can also be used to compensate the temperature in the ink chamber.

The control circuit 100 of the present invention measures the temperature (T) of the ink chamber in the print head. In the control procedure of the first embodiment, the calculation module 160 determines whether or not to generate a pre-heating signal in the driving signal and determines the pulse duration or the voltage level of the pre-heating signal according to both the heat accumulation effect and the heat dilution effect of the active nozzles. In the control procedure of the second embodiment, the calculation module determines the heat-accumulation weighting of all active nozzles, and in turn determines whether or not to generate a pre-heating signal in the driving signal and determines the pulse duration or the voltage level of the pre-heating signal according to the number of the adjacent active nozzles. The driving signal may use heating signals with the same pulse duration or the same voltage level while changing the pre-heating signals so as to meet the temperature compensation requirement. In the control procedure of the third embodiment, the calculation module determines whether or not to generate a pre-heating signal in the driving signal to a specific active nozzle according to the number of the adjacent active nozzles. In the control procedure of the fourth embodiment, the calculation module determines whether or not to generate a pre-heating signal in the driving signal and determines the pulse duration or the voltage level of the pre-heating signal according to the number of the adjacent active nozzles.

Figure 1:
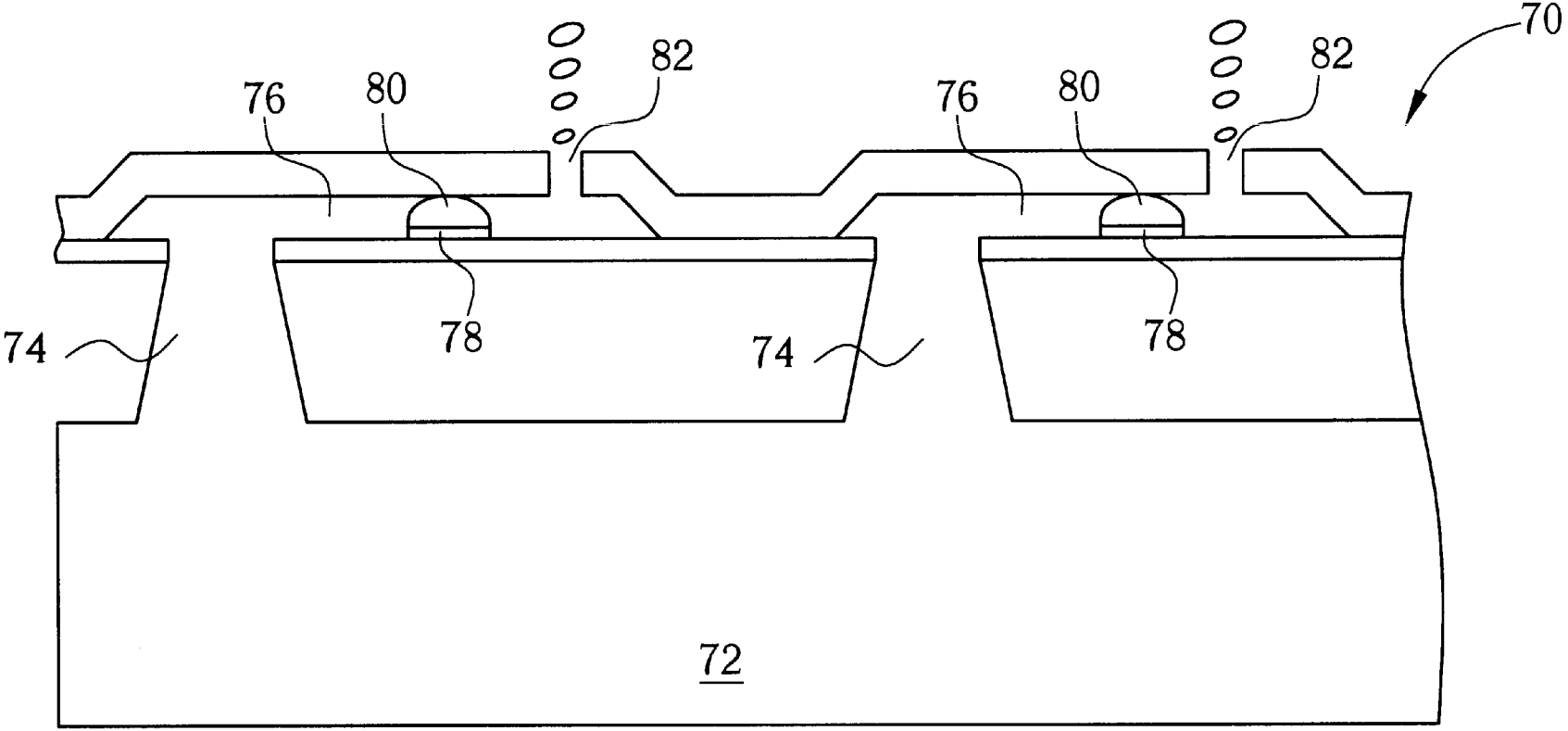
Fig. 1 Prior art
FIG. 1 is a schematic diagram of a prior art print head.

In FIG. 1 the heating devices (the heating resistor 78) are installed inside the ink chambers. It is noted that the heating devices may also be installed outside the ink chambers to heat up ink inside the ink chambers so as to jet ink drops out of the nozzles.

The prior art considers only the number of active nozzles, but does not consider the distribution of the active nozzles to determine proper driving signals. The present invention considers the distribution of the active nozzles by calculating the heat-accumulation effect of active nozzles and the heat-dilution effect of reserved nozzles, so a better determination of proper driving signals can be achieved. The present invention makes the thermal distribution of different ink chambers in the print head more uniform, makes the sizes of ejected ink drops uniform, and leads to better printing quality.

Those skilled in the art will readily observe that numerous modifications and alterations of the present invention may be made while retaining the teachings of the invention. Accordingly, the above disclosure should be construed as limited only by the metes and bounds of appended claims.

What is claimed is:

1. A control circuit for driving a print head of a printing apparatus, the print head comprising a plurality of heating elements and a plurality of corresponding ink chambers, each ink chamber being used for storing ink and having a nozzle, the control circuit comprising:

a calculation module for calculating heat-accumulation weightings of the nozzles according to printing data, and generating a total weight based on the heat-accumulation weightings; and a processor for generating a heating signal according to the printing data to drive the heating elements to heat the ink chambers corresponding to the nozzles which will jet ink so as to cause the nozzles to jet ink, and generating a pre-heating signal according to the total weight to drive the heating elements;

wherein if the processor is determined to generate the pre-heating signal, the processor will generate the pre-heating signal in addition to generating the heating signal so as to provide additional energy to drive the heating elements corresponding to the nozzles which will jet ink.

2. The control circuit of claim 1 further comprising a thermometer for measuring a temperature of the ink chambers, wherein the processor generates the pre-heating signal according to both the temperature measured by the thermometer and the total weight.

3. The control circuit of claim 1 further comprising a heat-accumulation weighting table for defining heat-accumulation weightings of the nozzles which will jet ink according to heat-accumulation weightings of nozzles adjacent to the nozzles which will jet ink.

4. The control circuit of claim 3 further comprising a memory for storing the heat-accumulation weighting table.

5. The control circuit of claim 4 wherein the memory further stores a reference temperature and a reference total weight, and the processor comparing the temperature measured by the thermometer with the reference temperature and comparing the total weight calculated by the calculation module with the reference total weight to determine if the pre-heating signal is to be generated.

6. The control circuit of claim 5 wherein the reference temperature and the reference total weight are capable of being reset.

7. The control circuit of claim 3 wherein greater distances between a nozzle which will jet ink and nearby nozzles which will jet ink correspond to a smaller heat-accumulation weighting of the nozzle.

8. control circuit of claim 3 wherein a greater number of nozzles which will jet ink adjacent to a nozzle which will jet ink corresponds to a higher heat-accumulation weighting of the nozzle.

9. control circuit of claim 3 further comprising a heat-dilution weighting table for defining heat-dilution weightings of nozzles which will not jet ink according to heat-dilution weightings of nozzles adjacent to the nozzles which will not jet ink.

10. The control circuit of claim 9 wherein the calculation module calculates the total weight according to the heat-accumulation weightings of all nozzles which will jet ink and the heat-dilution weightings of all nozzles which will not jet ink.

11. The control circuit of claim 10 wherein the total weight is calculated by subtracting a sum of the heat-dilution weightings of all nozzles which will not jet ink from a sum of the heat-accumulation weightings of all nozzles which will jet ink.

12. The control circuit of claim 1 wherein the total weight calculated by the calculation module determines a pulse duration of the pre-heating signal.

13. The control circuit of claim 1 wherein the total weight calculated by the calculation module determines a voltage level of the pre-heating signal.

14. The control circuit of claim 1 wherein the plurality of nozzles are linearly arranged.

15. The control circuit of claim 14 wherein the total weight equals to a sum of the heat-accumulation weightings of the nozzles which will jet ink.

16. The control circuit of claim 1 wherein the plurality of nozzles are arranged in a matrix manner with a plurality of rows and a plurality of columns.

17. The control circuit of claim 16 wherein calculation of the total weight includes following steps:

calculating a sum of heat-accumulation weightings of nozzles which will jet ink in each row to obtain a row weight;

calculating a sum of heat-accumulation weightings of nozzles which will jet ink in each column to obtain a column weight; and calculating a sum of all row weights and column weights to obtain the total weight.

18. A method for providing a pre-heating signal to a heating element of a nozzle on a print head in a printing process so as to compensate energy accumulation differences between different nozzles on the print head, the method comprising:

measuring a temperature of the print head;

calculating a first value to indicate the heat accumulation condition of the printing process based on the distribution of nozzles desired to jet ink in the printing process;

determining the pre-heating signal according to the measured temperature and the first value.

19. The method of claim 18, wherein the first value is calculated by referencing a heat-accumulation weighting table.

20. The method of claim 18, wherein the first value is calculated by counting the number of adjacent nozzles desired to jet ink in the printing process.

21. A method for providing a pre-heating signal to a heating element of a nozzle on a print head in a printing process so as to compensate energy accumulation differences between different nozzles on the print head, the method comprising:

calculating a first value to indicate a heat accumulation condition of the printing process based on distribution of nozzles that are desired to jet ink in the printing process;

determining the pre-heating signal according to the first value.

22. The method of claim 21, wherein the first value is calculated by referencing a heat-accumulation weighting table.

23. The method of claim 21, wherein the first value is calculated by counting the number of adjacent nozzles desired to jet ink in the printing process.

* * * * *